US010724546B2

(12) United States Patent
Morgan et al.

(10) Patent No.: US 10,724,546 B2
(45) Date of Patent: Jul. 28, 2020

(54) CENTRIFUGAL COMPRESSOR HAVING A CASING WITH AN ADJUSTABLE CLEARANCE AND CONNECTIONS FOR A VARIABLE FLOW RATE COOLING MEDIUM, IMPELLER CLEARANCE CONTROL APPARATUS FOR CENTRIFUGAL COMPRESSOR, AND IMPELLER CLEARANCE CONTROL METHOD FOR CENTRIFUGAL COMPRESSOR

(71) Applicant: Daikin Applied Americas Inc., Minneapolis, MN (US)

(72) Inventors: Jeffrey Allen Morgan, Fishersville, VA (US); Fumiaki Onodera, Minnetonka, MN (US); Tsuyoshi Ueda, Plymouth, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 195 days.

(21) Appl. No.: 15/229,502

(22) Filed: Aug. 5, 2016

(65) Prior Publication Data

US 2018/0038380 A1 Feb. 8, 2018

(51) Int. Cl.
*F04D 29/58* (2006.01)
*F01D 11/24* (2006.01)
(Continued)

(52) U.S. Cl.
CPC ..... *F04D 29/584* (2013.01); *F01D 11/24* (2013.01); *F04D 13/02* (2013.01); *F04D 13/06* (2013.01);
(Continued)

(58) Field of Classification Search
CPC .... F04D 29/287; F04D 29/058; F04D 29/162; F04D 29/622; F04D 29/052; F04D 29/286; F04D 29/464; F04D 27/0276
See application file for complete search history.

(56) References Cited

U.S. PATENT DOCUMENTS 3,695,791 A * 10/1972 Brundage ..... F04C 2/102 277/411
3,771,927 A * 11/1973 Schiller ..... F04D 15/0027 415/131
(Continued)

FOREIGN PATENT DOCUMENTS

JP 10-89296 A 4/1998
JP 2014-231826 A 12/2014
WO 02/086324 A2 10/2002

OTHER PUBLICATIONS

The International Search Report for the corresponding international application No. PCT/US2017/044801, dated Nov. 3, 2017.
(Continued)

*Primary Examiner* — Bryan M Lettman
*Assistant Examiner* — Timothy P Solak
(74) *Attorney, Agent, or Firm* — Global IP Counselors, LLP

(57) ABSTRACT

A centrifugal compressor includes a casing, a first impeller, a motor, a cooling medium delivery structure, a shaft, and a first bearing. The casing has a first inlet portion and a first outlet portion. The first impeller is attached to the shaft and disposed between the first inlet portion and the first outlet portion. A first axial gap exists between the first impeller and the casing. The shaft is rotatably supported and axially moveable with respect to the casing by the first bearing. The motor is arranged inside the casing to rotate the shaft. The cooling medium delivery structure is configured to vary a supply of a cooling medium to the casing. An impeller
(Continued)

clearance control apparatus for a centrifugal compressor includes a sensor and a controller. The controller controls a supply of a cooling medium to the casing based on a value detected by the sensor.

17 Claims, 14 Drawing Sheets

(51) Int. Cl.

| | |
|---|---|
| ***F04D 29/42*** | (2006.01) |
| ***F04D 25/06*** | (2006.01) |
| ***F04D 29/62*** | (2006.01) |
| ***F04D 17/12*** | (2006.01) |
| ***F04D 25/08*** | (2006.01) |
| ***F04D 13/06*** | (2006.01) |
| ***F04D 13/02*** | (2006.01) |
| ***F04D 27/02*** | (2006.01) |
| ***F04D 17/10*** | (2006.01) |
| ***F04D 29/053*** | (2006.01) |
| ***F04D 29/058*** | (2006.01) |
| ***F04D 29/16*** | (2006.01) |
| ***F04D 29/28*** | (2006.01) |

(52) U.S. Cl.

CPC ..... *F04D 13/0613* (2013.01); *F04D 17/10* (2013.01); *F04D 17/12* (2013.01); *F04D 25/06* (2013.01); *F04D 25/082* (2013.01); *F04D 27/0276* (2013.01); *F04D 29/053* (2013.01); *F04D 29/058* (2013.01); *F04D 29/162* (2013.01); *F04D 29/286* (2013.01); *F04D 29/287* (2013.01); *F04D 29/4206* (2013.01); *F04D 29/5806* (2013.01); *F04D 29/622* (2013.01)

(56) References Cited

U.S. PATENT DOCUMENTS

| | | | | | |
|---|---|---|---|---|---|
| 3,844,674 | A * | 10/1974 | Moriyama | F04D 23/008 | 415/55.1 |
| 4,804,905 | A | 2/1989 | Ding et al. | | |
| 4,896,499 | A * | 1/1990 | Rice | F01D 5/185 | 60/39.182 |
| 5,857,348 | A * | 1/1999 | Conry | F04D 25/06 | 62/209 |
| 5,980,218 | A * | 11/1999 | Takahashi | F04D 29/058 | 417/243 |
| 6,234,749 | B1 * | 5/2001 | Hasegawa | F01D 11/122 | 415/122.1 |
| 7,942,628 | B2 | 5/2011 | Takahashi et al. | | |
| 2006/0150668 | A1 * | 7/2006 | Ro | F04D 29/584 | 62/510 |
| 2010/0251750 | A1 | 10/2010 | Lifson et al. | | |
| 2017/0268806 | A1 | 9/2017 | Knopp et al. | | |

OTHER PUBLICATIONS

International Preliminary Report on Patentability including Written Opinion for the corresponding international application No. PCT/US2017/044801, dated Feb. 5, 2019.

* cited by examiner

CENTRIFUGAL COMPRESSOR HAVING A CASING WITH AN ADJUSTABLE CLEARANCE AND CONNECTIONS FOR A VARIABLE FLOW RATE COOLING MEDIUM, IMPELLER CLEARANCE CONTROL APPARATUS FOR CENTRIFUGAL COMPRESSOR, AND IMPELLER CLEARANCE CONTROL METHOD FOR CENTRIFUGAL COMPRESSOR

BACKGROUND

Field of the Invention

The present invention generally relates to a centrifugal compressor, an impeller clearance control apparatus for the centrifugal compressor, and an impeller clearance control method for the centrifugal compressor. More specifically, the present invention relates to a centrifugal compressor having a rotary shaft that supports an impeller and is supported by a bearing that is moveable in an axial direction of the shaft, and having a cooling medium delivery system that adjustably supplies a cooling medium to a case of the centrifugal compressor.

Background Information

A centrifugal compressor, also called a radial compressor or turbo compressor, achieves a pressure rise by using a rotor or impeller to impart velocity or kinetic energy to a fluid flowing through the centrifugal compressor. One application for a centrifugal compressor is to compress a refrigerant used in a chiller system, which is a refrigerating machine or apparatus that removes heat from a medium. Commonly a liquid such as water is used as the medium, and the chiller system operates in a vapor-compression refrigeration cycle to cool the liquid. The liquid can then be circulated through a heat exchanger to cool air or equipment as required. A necessary byproduct of the refrigeration cycle is waste heat, which must be exhausted from the refrigerant to the ambient air or, for greater efficiency, recovered for heating purposes. A chiller system including a centrifugal compressor is sometimes called a turbo chiller.

In a conventional (turbo) chiller, refrigerant is compressed in the centrifugal compressor and sent to a heat exchanger in which heat exchange occurs between the refrigerant and a heat exchange medium (liquid). This heat exchanger is referred to as a condenser because the refrigerant condenses in this heat exchanger. As a result, heat is transferred to the medium (liquid) so that the medium is heated. Refrigerant exiting the condenser is expanded by an expansion valve and sent to another heat exchanger in which heat exchange occurs between the refrigerant and a heat exchange medium (liquid). This heat exchanger is referred to as an evaporator because refrigerant is heated (evaporated) in this heat exchanger. As a result, heat is transferred from the liquid medium (e.g., water, as mentioned above) to the refrigerant, and the liquid is chilled. The refrigerant from the evaporator is then returned to the centrifugal compressor and the cycle is repeated.

A conventional centrifugal compressor basically includes a casing, an inlet guide vane, an impeller, a diffuser, a motor, various sensors and a controller. Refrigerant flows in order through the inlet guide vane, the impeller and the diffuser. Thus, the inlet guide vane is coupled to a gas intake port of the centrifugal compressor while the diffuser is coupled to a gas outlet port of the impeller. The inlet guide vane controls the flow rate of refrigerant gas into the impeller. The impeller is attached to a shaft that is rotated by the motor. The controller controls the motor, the inlet guide vane and the expansion valve. When the motor rotates the shaft, the impeller rotates inside the casing and increases the velocity of the refrigerant gas flowing into the centrifugal compressor. The diffuser works to transform the velocity of refrigerant gas (dynamic pressure), given by the impeller, into (static) pressure. In this manner, the refrigerant is compressed in a conventional centrifugal compressor. A conventional centrifugal compressor may have one or two stages. A motor drives the one or more impellers.

There are two basic types of impeller used in centrifugal compressors: an open type impeller and a closed type impeller. An open impeller has vanes or blades that are exposed or visible from the outside of the impeller. A closed type impeller has a cover or shroud which covers the vanes or blades from the outside and is fixed to the vanes or blades such that the shroud rotates integrally with the impeller. In the case of an open impeller, a portion of the casing that surrounds the impeller is sometimes called a "shroud" (hereinafter "shroud cover portion"). The shroud cover portion of a compressor having an open impeller is different from the shroud of a closed impeller in that the shroud cover portion of an open impeller is fixed to the casing and does not rotate integrally with the impeller.

See U.S. Pat. No. 7,942,628 and U.S. patent application publication No. 2010/0251750 as examples of conventional technology.

SUMMARY

A clearance is provided between the impeller and the inside of the casing such that the impeller does not contact the casing when the impeller rotates. In particular, an axial clearance is provided between an axially outward facing surface of the impeller and an axially inward facing surface of the casing (e.g., see the clearances L1, L2, Wf1, and Wf2 in the illustrated embodiments explained later). In the case of an open type impeller, the axial clearance is between an axially outward edge of the vanes or blades of the impeller and the shroud cover portion of the casing. Meanwhile, in the case of a closed type impeller, the axial clearance is between an axially outward surface of the shroud (which is fixed to the outside of the vanes or blades of the impeller) and the axially inward facing surface of the casing. Additionally, in the case of the closed type impeller, the axial clearance between an axially inward facing surface of the impeller and an axially outward facing surface of the casing may also be taken into consideration (e.g., see the clearances Wr1 and Wr2 in the illustrated embodiments explained later).

It has been discovered that heat generated by the operation of the motor and the action of compressing the refrigerant may cause the casing of the compressor to expand due to thermal expansion. Meanwhile, cooling structures provided to cool the motor and/or the casing may cause the casing to contract. Thus, during operation of a centrifugal compressor, the axial clearance of the impeller with respect to the casing may vary depending on such factors as temperature changes of the casing and a pressure difference between a space on an axially outward side of the impeller and a space on an axially inward side of the impeller. Such a change in the axial clearance may have an adverse effect on the performance of the centrifugal compressor. For example, if the clearance becomes too small, then there is the risk that the impeller will contact the casing when the impeller is rotating, which could cause damage to the centrifugal compressor. Meanwhile, if the axial clearance becomes too large, then the amount of refrigerant leakage from the centrifugal compressor may increase. Excessive leakage of refrigerant may cause the efficiency of the compressor to decline and could also pose environmental concerns depending on the type of refrigerant used. The optimum axial clearance may vary depending on structural features of the particular centrifugal compressor, but there is generally an axial clearance or range of axial clearances at which an optimum balance is achieved between such factors as minimizing leakage and maintaining a safe clearance with respect to the casing.

Therefore, there is a need for a centrifugal compressor configured such that the axial clearance between the impeller and the casing can be adjusted during operation of the centrifugal compressor. The ability to adjust the axial clearance varies depending on the structure of the centrifugal compressor. For example, if the rotary shaft that supports the impeller of the centrifugal compressor is supported with respect to the casing on a roller bearing or a plain sliding bearing, then it may not possible to adjust the axial clearance during operation of the centrifugal compressor because the bearing structure typically does not allow axial movement of the shaft with respect to the casing. Meanwhile, it has been discovered that if the shaft bearing is a magnetic bearing or a fluid bearing (e.g., a gas bearing), then it is possible adjust the axial clearance of the impeller by causing a slight displacement between the shaft and the casing. In the case of a magnetic bearing, for example, it is possible to adjust the axial clearance by adjusting the operating current supplied to the magnetic bearing such that an axial magnetic force acts to cause a slight displacement of the shaft with respect to the casing.

Adjusting the axial clearance by adjusting an operating current supplied to the magnetic bearing supporting the shaft can be an effective method in the case of a single stage centrifugal compressor having only one impeller. However, for example, if the centrifugal compressor is a two-stage compressor having a first stage impeller on one side and a second stage impeller on the other side with both impellers disposed at axially opposite ends of a single shaft, then it may be very difficult to adjust the axial clearance of one of the impellers without affecting the axial clearance of the other impeller. For example, if the current supplied to at least one magnetic bearing is adjusted such that the first stage impeller is shifted axially outward to decrease the axial clearance with respect to the casing, then, simultaneously, the position of the second stage impeller will be shifted axially inward such that the axial clearance of the second stage impeller increases. Since the axial clearance of both the first stage impeller and the second stage impeller typically need to be adjusted in the same manner (i.e., both increased or both decreased), adjusting the axial clearance to an optimum value at one of the two stages may cause the axial clearance at the other of the two stages to deviate farther away from the optimum value instead of toward the optimum value. Consequently, it is problematic to adjust the axial clearances of both the first and second stage impellers in a two-stage compressor by adjusting the current supplied to a magnetic bearing.

Thus, there is a further need for a centrifugal compressor and an impeller clearance control apparatus that enables the axial clearance of the impeller to be adjusted by a method other than adjusting the electric current supplied to a magnetic bearing of the centrifugal compressor. In particular, there is a need for a two-stage centrifugal compressor and an impeller clearance control that enables the axial clearance of a first stage impeller and the axial clearance of a second stage compressor to be adjusted either separately or otherwise in such a manner that adjusting the axial clearance of one of the impellers does not adversely affect the axial clearance of the other impeller. An object of the present invention is to provide such a centrifugal compressor and an apparatus and method for controlling the impeller clearance of the centrifugal compressor. Another object of the present invention is to provide such a centrifugal compressor and such an impeller clearance control apparatus without requiring additional sensors and mechanical parts that may increase the cost and complexity of the centrifugal compressor.

One or more of the foregoing objects can basically be achieved by providing centrifugal compressor comprising a casing, a first impeller, a motor, a shaft, and a cooling medium delivery structure. The casing has a first inlet portion and a first outlet portion. The first impeller is disposed between the first inlet portion and the first outlet portion. The first impeller is attached to the shaft, and the shaft is rotatable about a rotation axis. A first axial gap exists between the first impeller and the casing. The motor is arranged inside the casing to rotate the shaft in order to rotate the first impeller. The motor includes a rotor mounted on the shaft and a stator disposed radially outwardly of the rotor to form a radial gap between the rotor and the stator. The cooling medium delivery structure includes an inlet conduit located to supply a cooling medium to the casing and an outlet conduit located to discharge the cooling medium from the casing. The cooling medium delivery structure is configured to vary a flow rate of the cooling medium supplied to the casing. The shaft has a first end and a second end, and the first impeller is attached to the first end of the shaft. A portion of the shaft between the first end and the rotor is supported with respect to the casing by a first bearing. The first bearing is moveable with respect to the shaft in an axial direction of the shaft.

The foregoing objects may be further achieved by providing a control apparatus including a sensor and a controller programmed to control the supply of the cooling medium to the casing based on a value detected by the sensor such that the first axial gap is adjusted to a target axial gap value using thermal expansion and contraction of the casing.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENT(S)

Selected embodiments (i.e., a first embodiment, a second embodiment, and variations thereof) will now be explained with reference to the drawings. It will be apparent to those skilled in the art from this disclosure that the following descriptions of the embodiments are provided for illustration only and not for the purpose of limiting the invention as defined by the appended claims and their equivalents. In particular, a number of features illustrated in the first embodiment are interchangeable with features of the second embodiment. For example, although the first embodiment features an open impeller, a partition separating first stage and second stage sides of the casing, and bellows joints in the casing, it is acceptable to use a partition or a bellows joint in the second embodiment together with the closed impeller of the second embodiment.

Figure 1:
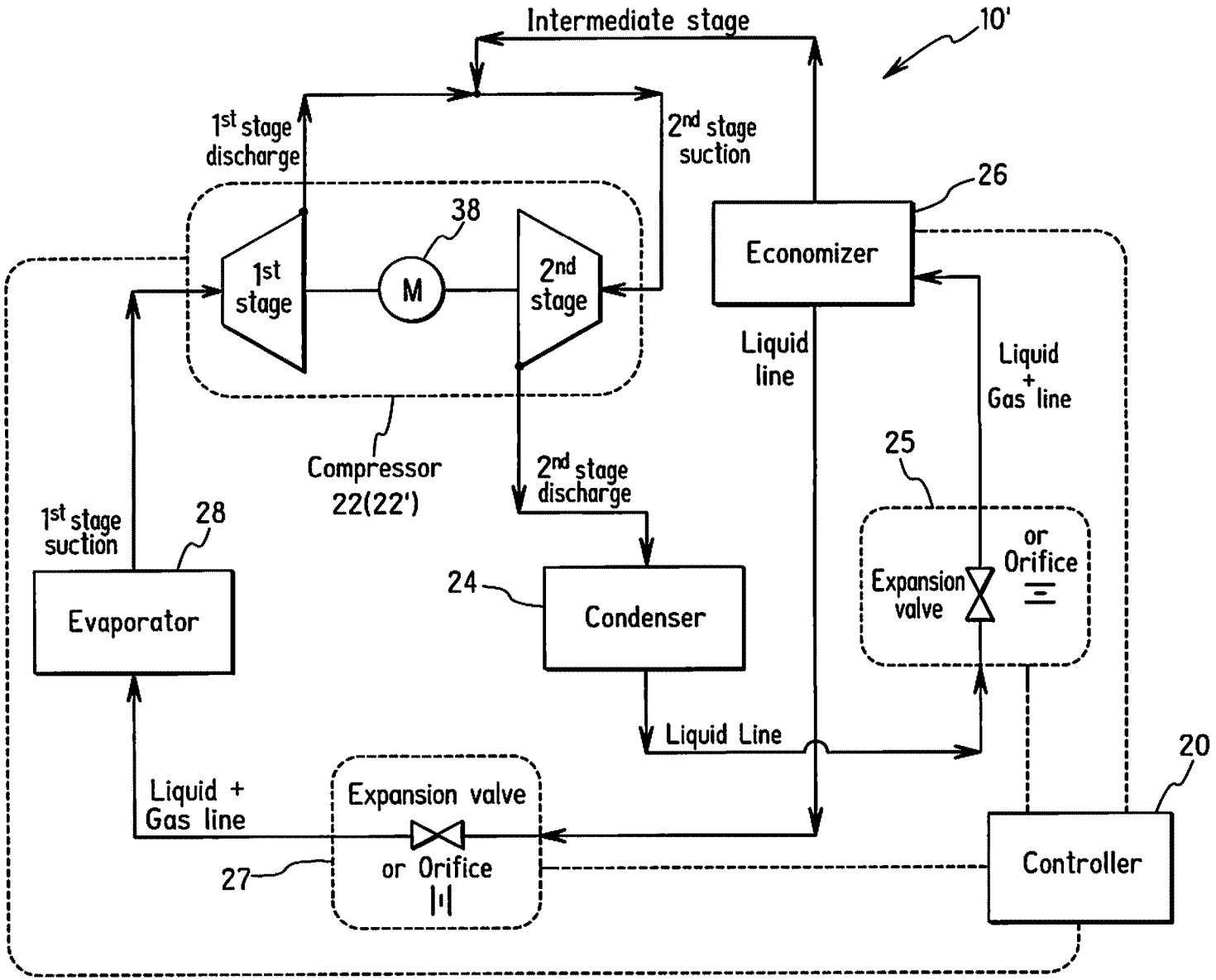
FIG. 1 is a schematic diagram illustrating a two stage chiller system (with an economizer) having a two-stage centrifugal compressor in accordance with the present invention.

Referring initially to FIG. 1, a chiller system 10 having a centrifugal compressor 22 in accordance with an embodiment of the present invention is illustrated. The centrifugal compressor 22 (22') of FIG. 1 is a two stage compressor, and thus, the chiller system 10 of FIG. 1 is a two stage chiller system. The two stage chiller system of FIG. 1 also optionally includes an economizer 26. The chiller system 10 is conventional, except for the centrifugal compressor 22 and the cooling medium delivery structure supplying the cooling medium to the casing 30 of centrifugal compressors 22. Therefore the chiller system 10 will not be discussed and/or illustrated in detail herein except as related to the centrifugal compressor 22 and the cooling medium delivery structures of the centrifugal compressors 22. However, it will be apparent to those skilled in the art that the conventional parts of the chiller system 10 can be constructed in variety of ways without departing the scope of the present invention.

In the illustrated embodiments, the chiller system 10 is preferably a water chiller that utilizes cooling water and chiller water in a conventional manner. FIG. 1 merely illustrates one example of a chiller system 10 in which a centrifugal compressor 22 in accordance with the present invention can be used. For example, it is also acceptable to employ the present invention in a single stage centrifugal compressor. However, the present invention is deemed to have particular advantages in a two stage centrifugal compressor or any other compressor having two impellers arranged at axially opposite ends of the compressor.

Referring again to FIG. 1, the components of the chiller system 10 will now briefly be explained. The chiller system 10 basically includes a chiller controller 20, the centrifugal compressor 22 (22'), a condenser 24, an expansion valve or orifice 25, an economizer 26, an expansion valve or orifice 27, and an evaporator 28 connected together in series to form a loop refrigeration cycle. Various sensors (not shown) are disposed throughout the circuits of the chiller system 10 to control the chiller system 10 in a conventional manner. Such sensors and use of information from such sensors to control the chiller system 10 is conventional, and thus, will not be explained and/or illustrated in detail herein except as related to controlling the centrifugal compressor 22 in accordance with the present invention. Therefore, it will be apparent to those skilled in the art from this disclosure that an explanation of normal operation of the chiller system 10 has been omitted for the sake of brevity, except as related the structure and operation of the centrifugal compressor 22.

The centrifugal compressor 22 (22') is a two stage compressor. However, the compressor 22 may include three or more impellers (not shown) or may be a single stage compressor. It will be apparent to those skilled in the art from this disclosure that although the present invention is applicable to a single stage compressor, the present invention is particularly relevant to a two stage compressor (e.g., the centrifugal compressor 22) due to the problems of adjusting the impeller clearance on both the first stage side and the second stage side with conventional technology. Therefore, the two stage compressor 22 includes all the parts of a single stage compressor, but also includes additional parts. Accordingly, it will be apparent to those skilled in the art from this disclosure that the descriptions and illustrations of the two stage compressor 22 also apply to a single stage compressor, except for parts relating to the second stage of compression and modifications related to the second stage of compression (e.g., the housing shape, shaft end shape, etc.). In view of these points, and for the sake of brevity, only the two stage compressor 22 will be explained and/or illustrated in detail herein.

Figure 2:
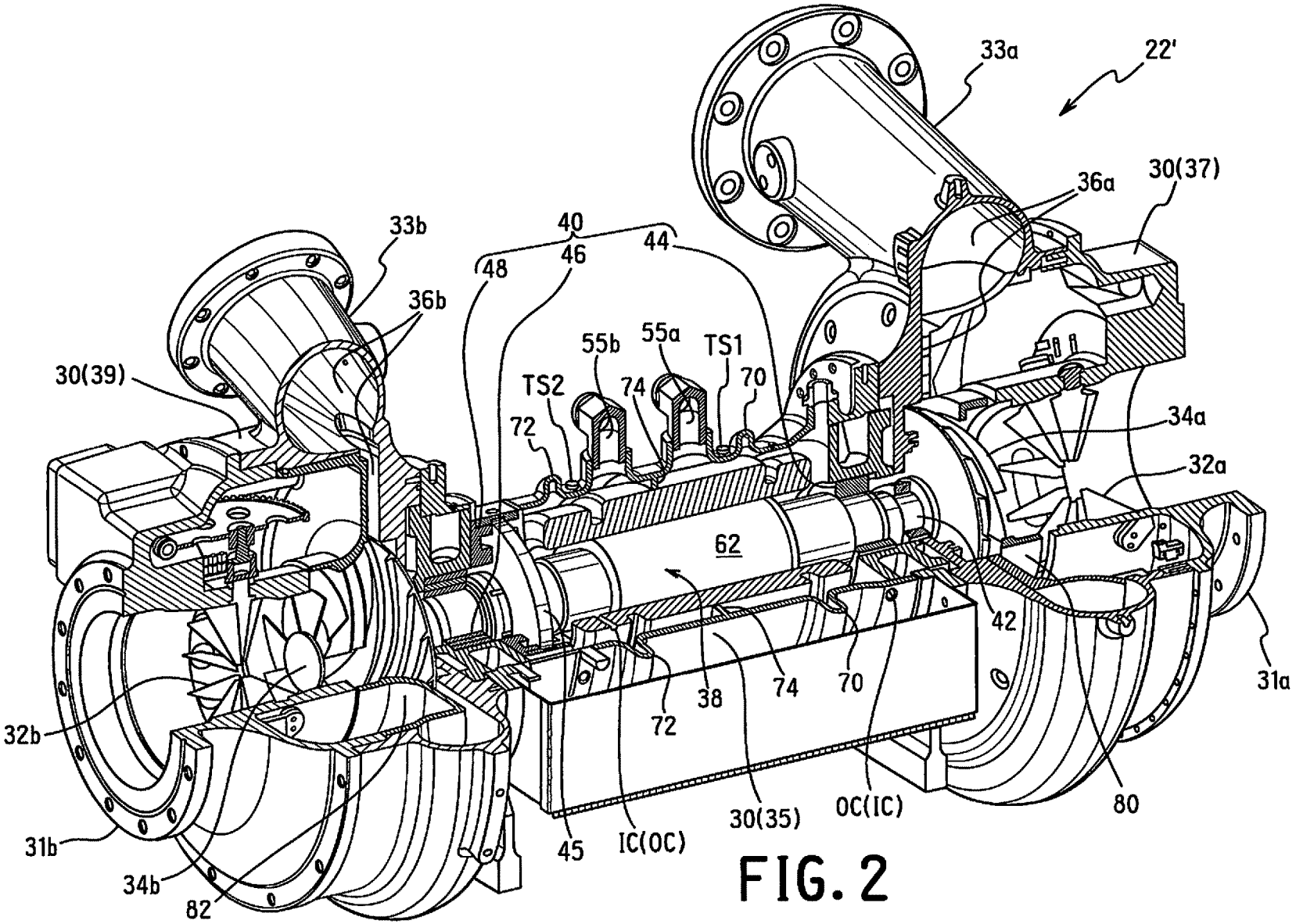
FIG. 2 is a perspective view of the centrifugal compressor of the chiller system illustrated in FIG. 1 in accordance with a first embodiment featuring an open impeller, with portions broken away and shown in cross-section for the purpose of illustration.
Figure 3:
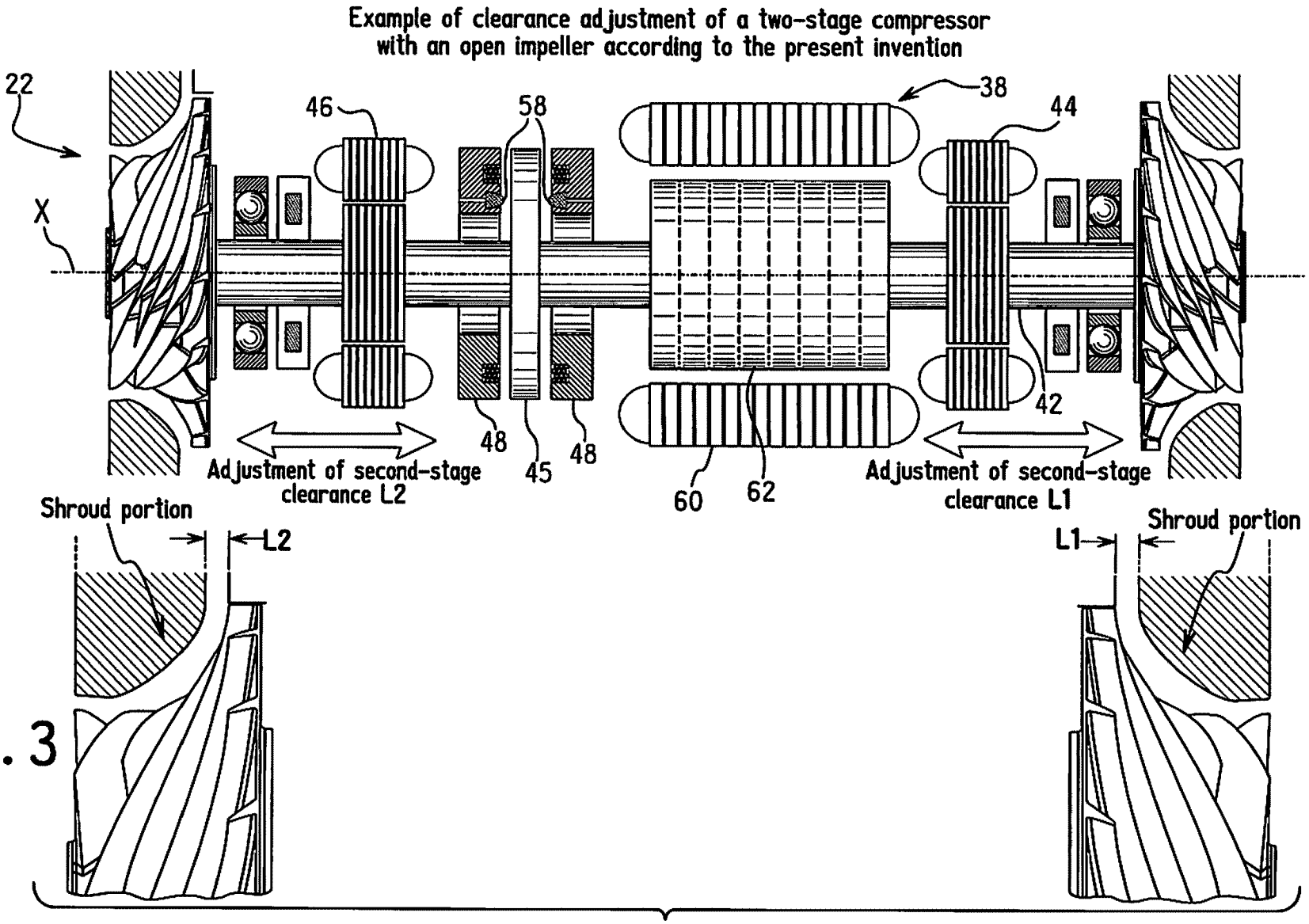
FIG. 3 is a simplified internal side view of internal parts (e.g., shafts, impellers, magnetic bearings and motor) of the centrifugal compressor illustrated in FIG. 2 and illustrates an impeller clearance adjustment.
Figure 4:
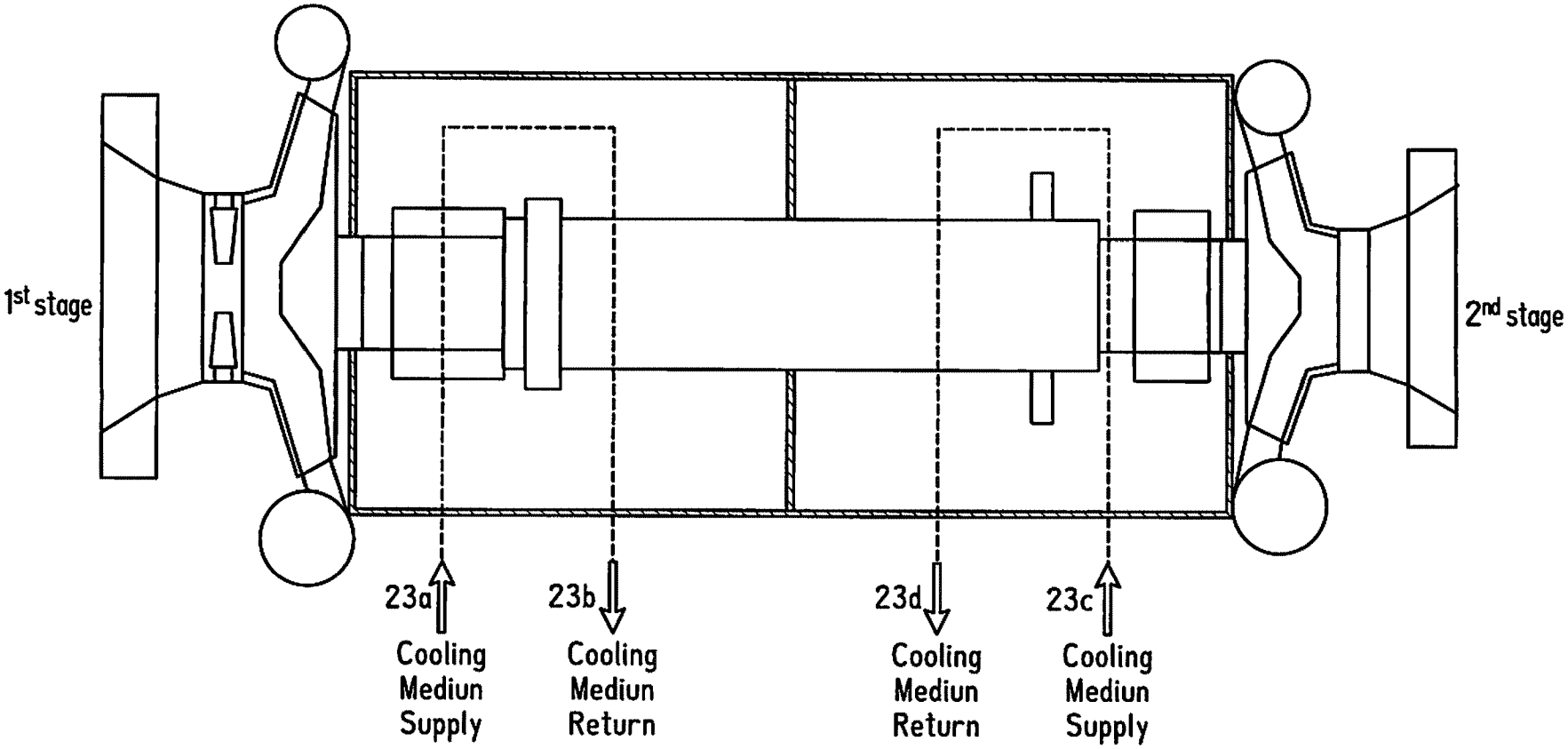
FIG. 4 is simplified internal side view of the internal parts (e.g., shafts, impellers, magnetic bearings and motors) of the centrifugal compressor illustrated in FIG. 3 and illustrates an arrangement of the cooling medium delivery structure according to the first embodiment.
Figure 7:
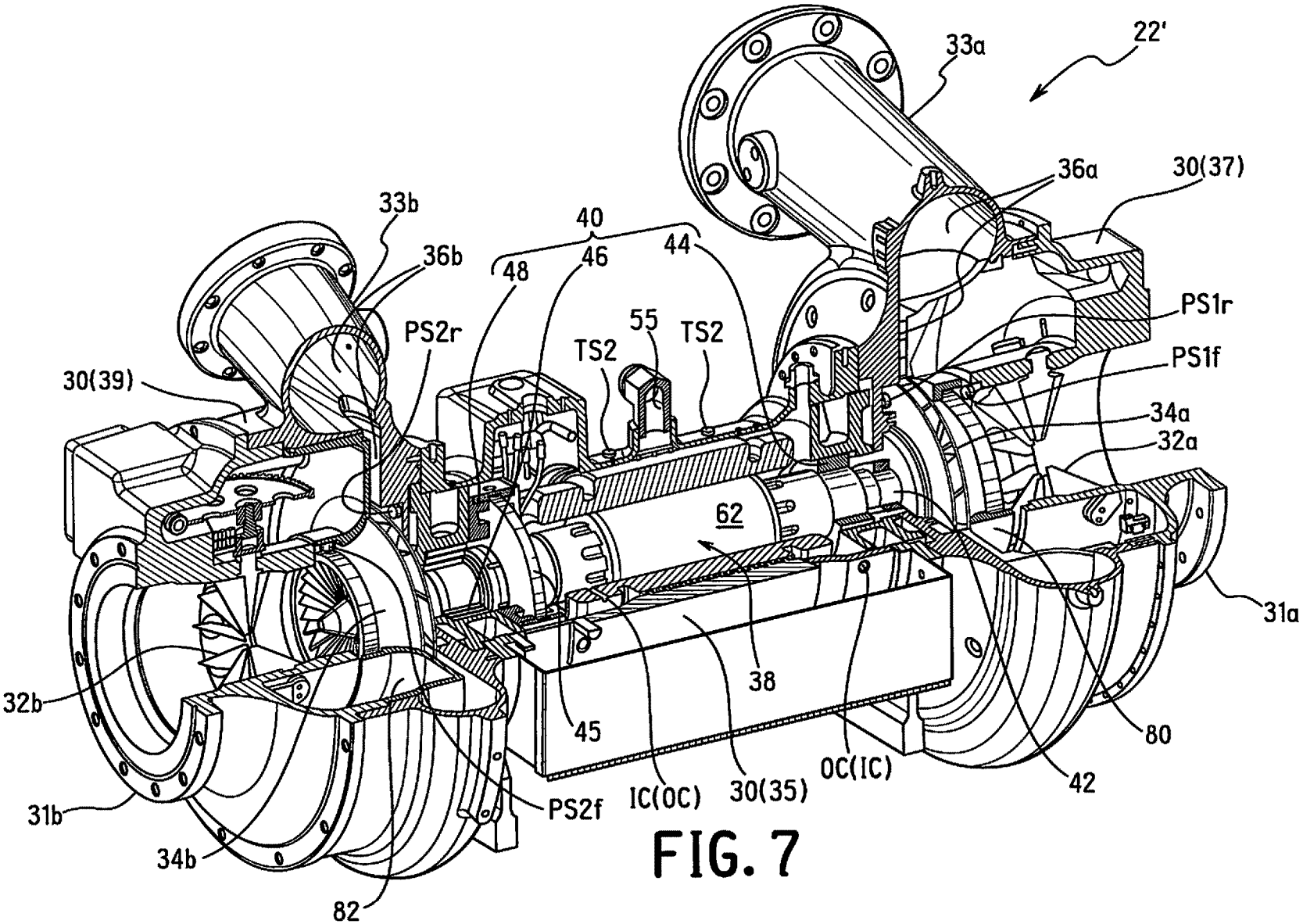
FIG. 7 is a perspective view of the centrifugal compressor of the chiller system illustrated in FIG. 1 in accordance with a second embodiment featuring a closed impeller, with portions broken away and shown in cross-section for the purpose of illustration.
Figure 8:
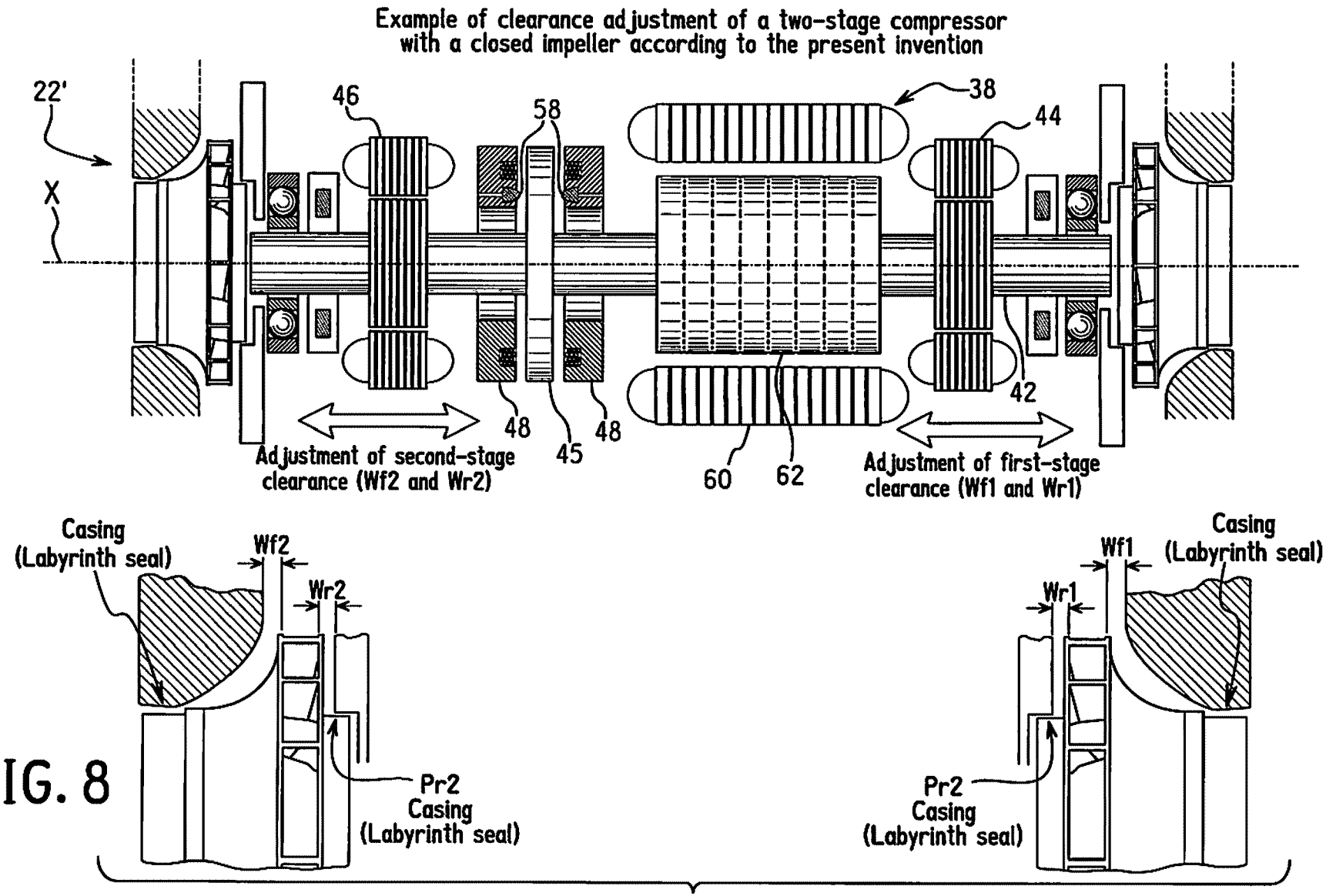
FIG. 8 is a simplified internal side view of internal parts (e.g., shafts, impellers, magnetic bearings and motor) of the centrifugal compressor illustrated in FIG. 7 and illustrates an impeller clearance adjustment.
Figure 9:
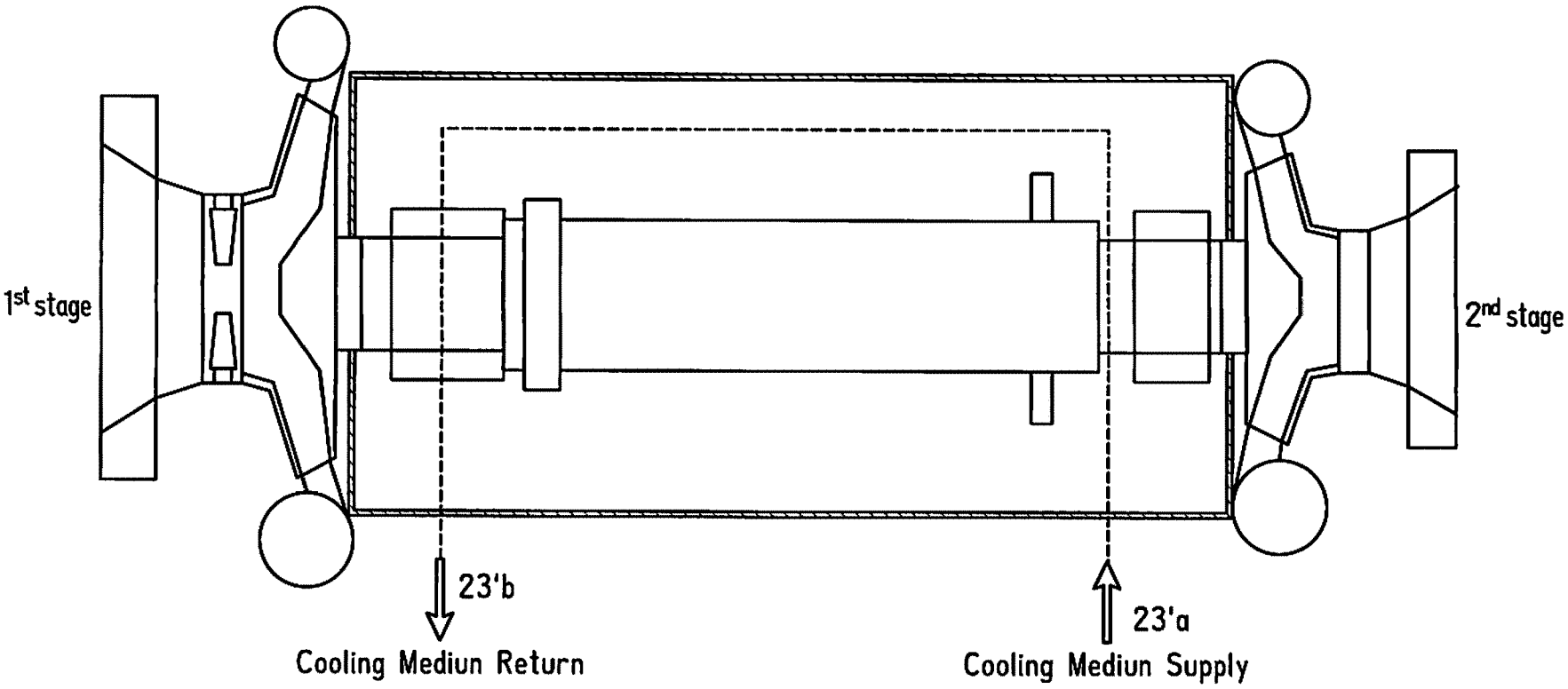
FIG. 9 is a simplified internal side view of the internal parts (e.g., shafts, impellers, magnetic bearings and motors) of the centrifugal compressor illustrated in FIG. 8 and illustrates an arrangement of the cooling medium delivery structure according to the second embodiment.
Figure 11:
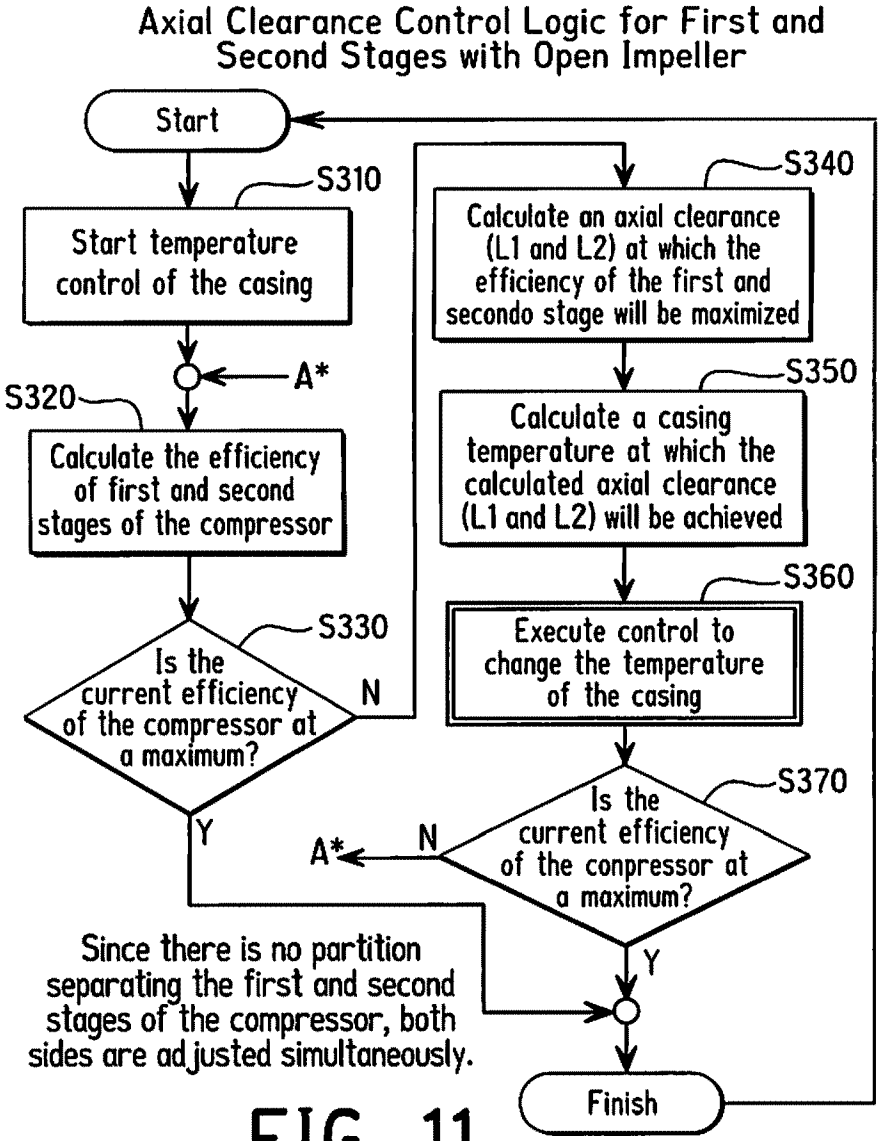
FIG. 11 is a flowchart illustrating a control logic for adjusting the axial clearance of the first and second stage impellers in a variation of the second embodiment having an open impeller.
Figure 10:
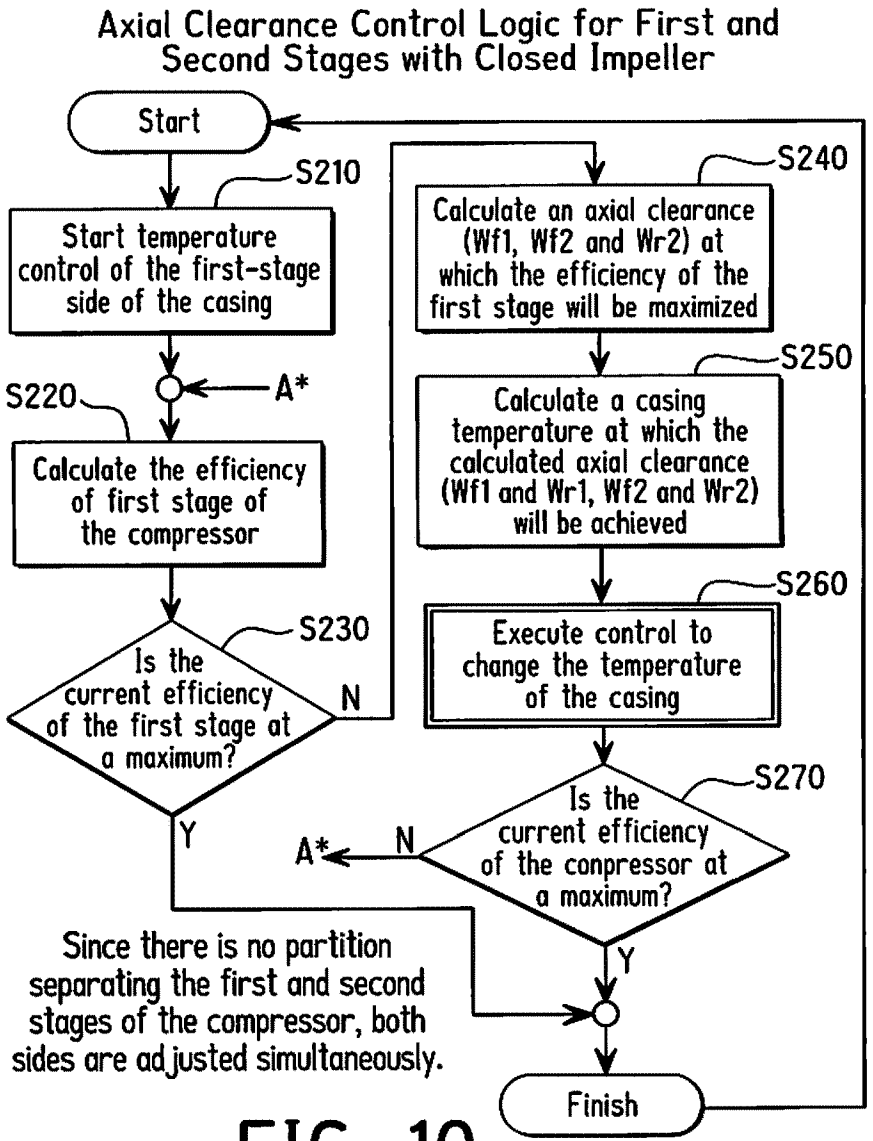
FIG. 10 is a flowchart illustrating a control logic for adjusting the axial clearance of the first and second stage impellers in the second embodiment.

Referring now briefly to FIGS. 2-11, it will be recognized by those of ordinary skill from this disclosure that there are a number of options regarding the type of impeller and the configuration of the cooling medium delivery structure 23 or 23' of the centrifugal compressor 22 (first embodiment) or 22' (second embodiment) in the chiller system 10. In particular, the centrifugal compressor 22 or 22' may have open-type impellers or closed type-impellers. Also, the casing 30 may or may not be provided with an internal partition 74 separating the first stage side from the second stage side, and separate passages may or may not be provided on the first stage side and the second stage side for receiving separate supplies of the cooling medium. FIG. 1 does not illustrate the cooling medium delivery structures 23 and 23' shown in FIGS. 4 and 9 because it would be difficult to show the internal routing of the cooling medium delivery structure in FIG. 1. However, it will be apparent to those skilled in the art from this disclosure that either of the options shown in FIGS. 4 and 9 can be incorporated in the chiller system 10 illustrated in FIG. 1 as indicated above in the Brief Descriptions of the Drawings. Additional examples of more detailed arrangements are shown in FIGS. 10 and 11. In addition it will be apparent to those skilled in the art from this disclosure that the economizer 26 of the chiller system 10 can be eliminated when not used for providing a cooling medium to the casing of the centrifugal compressor 22 or 22' as shown in FIGS. 4 and 9.

Referring again to FIGS. 2-11, a first embodiment and a second embodiment will be explained. The main difference between the first embodiment and the second embodiment is that the first embodiment features a partition 74 in the casing 30 that separates the casing 30 into a first stage side and a second stage side, and separate cooling medium delivery passages 23*a*, 23*b*, 23*c* and 23*d* are provided with respect to the first stage side and the second stage side, respectively, of the casing 30. Conversely, the second embodiment does not include a partition and the same cooling medium delivery passages 23*a*' and 23*b*' are used to adjust the impeller clearance on both the first stage side and the second stage side. There are other differences between the first and second embodiments, but, as previously mentioned, it will be recognized by those of ordinary skill from this disclosure that many of these other features can be used interchangeably between the two embodiments. For example, the first embodiment features a bellows joint in the casing 30 and the second embodiment does not feature a bellows joint. However, it is also acceptable to use a bellows joint in the second embodiment. Similarly, the second embodiment features labyrinth seals between the rotary shaft 42 and the casing 30, but it is also acceptable to use labyrinth seals in the first embodiment. The first and second embodiments will now be explained in detail.

First Embodiment

The first embodiment is illustrated in FIGS. 2-6. In the first embodiment, the compressor 22 is a two-stage centrifugal compressor. The centrifugal compressor 22 includes a casing 30 that houses a motor 38, a first stage impeller 34*a*, and a second stage impeller 34*b*. In the first embodiment, the first and second stage impellers 34*a* and 34*b* are open type impellers, but it is also acceptable for the first and second stage impellers 34*a* and 34*b* to be closed type impellers. As shown in FIGS. 2 and 3, the motor 38 is disposed between the first stage impeller 34*a* and the second stage impeller 34*b*. The casing 30 includes a first inlet portion 31*a* and a first outlet portion 33*a* that guide a refrigerant toward and away from the first stage impeller 34*a*. Similarly, the casing 30 includes a second inlet portion 31*b* and a second outlet portion 33*b* that guide the refrigerant toward and away from the second stage impeller 34*b*. The centrifugal compressor 22 further includes a first stage inlet guide vane 32*a* disposed between the first inlet portion 31*a* and the first stage impeller 34*a*, and a first diffuser/volute 36*a* disposed between the first stage impeller 34*a* and the first outlet portion 33*a*. Similarly, the centrifugal compressor 22 includes a second stage inlet guide vane 32*b* disposed between the second inlet portion 31*b* and the second stage impeller 34*b*, and a second diffuser/volute 36*b* disposed between the second stage impeller 34*b* and the second outlet portion 33*b*.

The casing 30 further includes a motor housing portion 35 that is disposed axially between the first stage impeller 34*a* and the second stage impeller 34*b* and configured to enclose the motor 38. In the illustrated embodiment, the motor housing portion 35 has a generally cylindrical shape and fixedly supports a stator 60 of the motor 38 on an inside of the motor housing portion 35. In addition to the stator 60, the motor 38 of the illustrated embodiment also includes a rotor 62 that is mounted on a middle portion of a rotary shaft 42. The shaft 42 has a first end on which the first stage impeller 34*a* is mounted and a second end on which the second stage impeller 34*b* is mounted. The motor housing portion 35 includes at least one port 55 (55*a*, 55*b*) for discharging the cooling medium supplied by the cooling medium delivery structure 23 or 23' from the casing 30. A similar port or ports (not shown) may be provided for supplying the cooling medium to the casing 30. The number and arrangement of ports may vary according to the particular configuration of the cooling medium delivery structure 23 or 23'. Although centrifugal compressor 22 of the illustrated embodiment has a motor 38 and a single shaft 42 with both the first impeller 34*a* and the second impeller 34*b* attached to the shaft 42, the present invention is also applicable to a centrifugal compressor provided with a separate motor and shaft for each of the first and second stage sides of the compressor. Also, as mentioned previously, the present invention is also applicable to a single stage compressor.

As shown in FIG. 2, the casing 30 further includes a first end portion 37 that joins a first end of the motor housing portion 35 and surrounds the first stage impeller 34*a*. The casing 30 also includes a second end portion 39 that joins a second end of the motor housing portion 35 and surrounds the second stage impeller 34*b*. The first end portion 37 includes a first shroud cover portion 80 that is arranged closely adjacent the first stage impeller 34*a* on an inlet side (axially outward side) of the first stage impeller 34*a*. In the illustrated embodiment, the first shroud cover portion 80 has a curved shape that generally corresponds to a contour of the inlet side of the first stage impeller 34*a*. Likewise, the second end portion 39 includes a second shroud cover portion 82 that is arranged closely adjacent the second stage impeller 34*b* on an inlet side (axially outward side) of the second stage impeller 34*b*. In the illustrated embodiment, the second shroud cover portion 82 has a curved shape that generally corresponds to a contour of the inlet side of the second stage impeller 34*b*. As will be explained in more detail later, a first axial gap or impeller clearance L1 exists between the first shroud cover portion 80 and the first stage impeller 34*a*, and a second axial gap or impeller clearance L2 exists between the second shroud cover portion 82 and the second stage impeller 34*b*.

The shaft 42 of the centrifugal compressor 22 of the illustrated embodiment is supported on a magnetic bearing assembly 40 that is fixedly supported to the casing 30. The magnetic bearing assembly 40 includes a first radial magnetic bearing 44, a second radial magnetic bearing 46, and an axial magnetic bearing 48. As shown in FIG. 3, the axial magnetic bearing 48 supports the shaft 42 along a rotational axis X by acting on a thrust disk 45. The axial magnetic bearing 48 includes the thrust disk 45 which is attached to the shaft 42. The thrust disk 45 extends radially from the shaft 42 in a direction perpendicular to the rotational axis X, and is fixed relative to the shaft 42.

A magnetic bearing is a bearing that uses magnetic force to levitate a rotary shaft such that the shaft can rotate with very low friction. Due to the structure and operating mechanism of a magnetic bearing assembly 40, relative axial movement between the magnetic bearing assembly 40 and the shaft 42 is permitted to at least a certain degree. Consequently, when the casing 30 elongates and contracts in an axial direction of the shaft 42 due to temperature changes of the casing 30, the magnetic bearing assembly 40 allows the casing 30 to move with respect to the shaft 42. While magnetic bearings are described herein, it will be apparent to those skilled in the art from this disclosure that other types and forms of bearings maybe used in the compressor according to this invention so long as the bearing allows movement in the axial direction of the shaft 42. For example, a gas bearing or other fluid type bearing may be used. In any case, it will be apparent to those skilled in the art from this disclosure that the present invention is particularly suited to a compressor having magnetic bearings.

In the first embodiment, two bellows joints 70 and 72 are provided in the motor housing portion 35 of the casing 30. One of the bellows joints 70 is provided in a position between the first stage impeller 34*a* and the motor 38 along the axial direction of the shaft 42, and the other of the bellows joints 72 is provided in a position between the second stage impeller 34*b* and the motor 38 along the axial direction of the shaft 42. As will be explained later, the bellows joints 70 and 72 help promote thermal expansion and contraction of the casing 30 in response to temperature changes of the casing 30 and, thereby, assist in the control of the impeller clearance according to the present invention.

The two-stage centrifugal compressor 22 of the illustrated first embodiment is conventional except that the compressor 22 includes a cooling medium delivery structure 23 to supply a cooling medium to the casing 30 of the compressor 22 as shown FIG. 4 of the drawings. The cooling medium delivery structure 23 may be a structure that is also provided for the purpose of cooling the motor 38 during normal operation of the compressor 22. The cooling medium may be the same refrigerant as is used in the chiller system 10 as a whole and may be fed from an appropriate portion of the refrigeration circuit of the chiller system 10. For example, in the first embodiment, the cooling medium (e.g., a refrigerant) may be supplied from the condenser 24 and returned to the evaporator 28 or supplied from the evaporator 28 and returned to the evaporator 28 of the chiller system 10 (e.g., see FIGS. 13-16). Alternatively, a dedicated refrigeration circuit for cooling the casing 30 of the compressor 22 may be provided separately from the refrigeration circuit of the chiller system 10. Persons of ordinary skill in the refrigeration and air conditioning fields will understand that there are various ways in which the cooling medium delivery structure 23 may be configured. Therefore, this disclosure does not provide an extensive description of all possible configurations of the cooling medium delivery structure 23. However, explanations of the examples shown in FIGS. 13-16 is provided later in this specification (after the description of the second embodiment).

In the first embodiment, as shown in FIG. 2, an internal partition 74 is provided inside the casing 30 to separate a first stage side of the casing 30 and a second stage side of the casing 30. In the first embodiment, the partition 74 is provided at an approximate middle position of the casing 30 along the axial direction of the shaft 42. Additionally, in the first embodiment, the cooling medium delivery structure 23 is configured to have separate a separate cooling medium passage for each of the first stage side of the casing 30 and the second stage side of casing 30. Thus, as shown in FIG. 4, the cooling medium delivery structure 23 of the first embodiment includes a first stage cooling medium supply passage 23*a*, a first stage cooling medium return passage 23*b*, a second stage cooling medium supply passage 23*c*, and a second stage cooling medium return passage 23*d*. However, the cooling medium delivery structure 23 is not limited to the particular structure shown in FIG. 4. Various configurations for delivering a cooling medium are possible. For example, it is possible for multiple cooling medium supply passages and/or multiple cooling medium return passages to be provided with respect to each of the first stage side and the second stage side of the casing 30. Additionally, it will be recognized by those skilled in the art from this disclosure that various configurations may be adopted for routing the cooling medium through the casing 30 in order to cool the casing with the cooling medium.

The chiller controller 20 receives signals from the various sensors and controls the inlet guide vanes 32*a* and 32*b*, the compressor motor 38, and the magnetic bearing assembly 40 in a conventional manner. Therefore, a detailed description of the control and operation of the inlet guide vanes 32*a* and 32*b*, the compressor motor 38, and the magnetic bearing assembly 40 is omitted in this specification for the sake of brevity. In the first embodiment, the chiller controller 20 also controls the supply of cooling medium to the casing 30 in accordance with the present invention as explained below. It will be recognized by those skilled in the art that the present invention is not limited to using the chiller controller 20 of the chiller system 10 to control the supply of cooling medium to the casing 30 via the cooling medium delivery structure 23 for controlling the impeller clearances L1 and L2. For example, it is also acceptable to use a separate dedicated controller specifically for controlling the supply of cooling medium via the cooling medium delivery structure 23.

The control of the impeller clearance (clearances L1 and L2) executed by the controller 20 in accordance with the first embodiment will now be explained with reference to FIG. 5. Although the control will be explained with reference to the first stage side of the compressor 22, it will be recognized that the same control steps may be executed with respect to the second stage side of the compressor 22. In step S10, the controller 20 starts the impeller clearance control. In step S20, the controller 20 calculates an efficiency of the first stage side of the compressor 22 based on such factors as rotational speed of the compressor 22, a pressure difference across the first stage impeller 34*a*, and a flow rate of the refrigerant through the first stage side of the compressor 22. Then, in step S30, the controller 20 determines if the calculated efficiency of the first stage side of the compressor 22 is at a prescribed maximum efficiency value. If the calculated efficiency is the maximum efficiency, then the controller 20 ends the impeller clearance control. Otherwise, if the calculated efficiency is below the maximum efficiency, then the controller 20 proceeds to step S40.

In step S40, the controller 20 calculates a value of the axial clearance L1 at which the efficiency of the first stage will be maximized. Then, in step S50, the controller 20 calculates a casing temperature at which the axial clearance L1 will be equal to the calculated axial clearance value at which the efficiency of the first stage of the compressor will be maximized. In step S60, the controller 20 executes a control to change the temperature of the casing to match the casing temperature calculated in step S50. The controller 20 executes the control to change the temperature of the casing 30 by, for example, adjusting an opening degree of a flow control valve (e.g., see FIGS. 13-16) of the cooling medium delivery structure 23 to control a flow rate of the cooling medium flowing to the first stage side of the casing 30. For example, if a current temperature of the casing detected by a pair of temperature sensors TS1 and TS2 is higher than the casing temperature calculated in step S50, then the controller 20 may execute control to increase the opening degree of the flow control valve and increase the flow of the cooling medium such that the actual temperature of the casing 30 is decreased. Conversely, if the current temperature of the casing is lower than the casing temperature calculated in step S50, then the controller 20 may execute control to decrease the opening degree of the flow control valve and decrease the flow of the cooling medium such that the actual temperature of the casing 30 is increased. In this way, the controller 20 can control the size of the axial clearance L1 of the first stage impeller 34*a* to the value calculated in step S40. See FIG. 12 (explained later) for an example of the control logic of step S60.

Next, in step S70, the controller 20 again determines if the calculated efficiency of the first stage side of the compressor 22 is at the prescribed maximum efficiency value. If the result of step S70 is that the calculated efficiency of the first stage side of the compressor 22 is at the prescribed maximum efficiency value, then the controller 20 ends the control sequence. If the result of step S70 is that the calculated efficiency is below the prescribed maximum efficiency value, then the controller 20 returns to step S20 of the control sequence.

Figure 5:
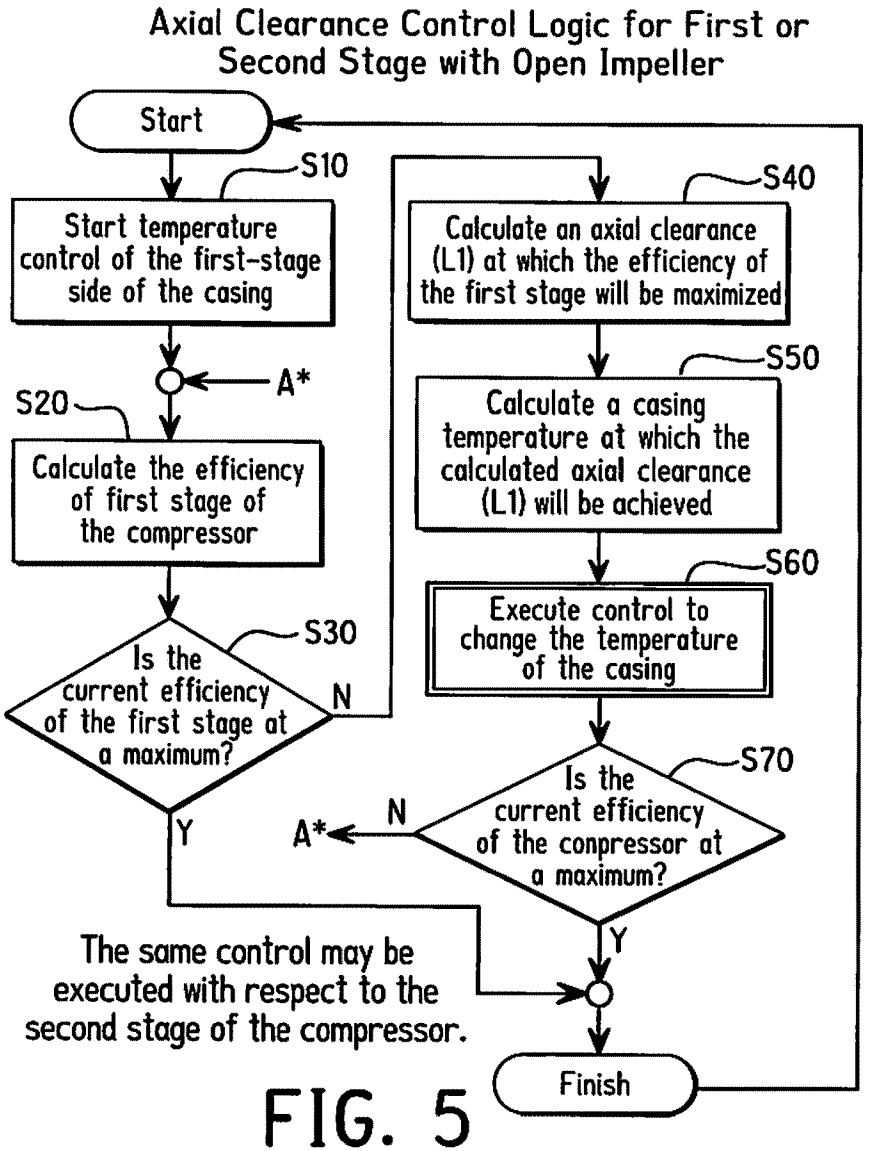
FIG. 5 is a flowchart illustrating a control logic for adjusting the axial clearance of the first stage impeller in the first embodiment.

By executing the control sequence shown in FIG. 5, the controller 2 adjusts the temperature of the casing 30 and thereby adjusts the axial clearance L1 of the first stage impeller 34*a* such that the first stage side of the compressor operates at a maximum efficiency. In other words, the controller 20 controls the axial clearance L1 to the value calculated in step S40. As mentioned above, various factors may be taken into account in calculating the maximum efficiency of the first stage of the compressor 22. For example, an amount of refrigerant leakage, a performance level, and a chance of contact of the impeller 34*a* against the casing 30 may be correlated to the axial clearance L1, and a target value of the axial clearance L1 corresponding to an ideal balance of the various factors may be selected as the value of the axial clearance L1 at which the efficiency of the first stage will be maximized calculated in step S40. For example, see Table 1 below.

TABLE 1

| Clearance L1 | Leakage amount | Performance | Chance of contact |
|---|---|---|---|
| 0.2 mm | ↓ | 100% | ↑ |
| 0.5 mm | ↑ | 98% | ↓ |

A similar table to Table 1 may be made with respect to the axial clearance L2 of the second stage impeller 34*b*. Depending on the structure of the compressor 22 the response of the axial clearance L2 of the second stage impeller 34*b* may be substantially the same as the response of the axial clearance L1 of the first stage impeller 34*a*. That is, if the correlation between the temperature of the casing 30 and the value of the axial clearance L2 is generally the same as the correlation between the temperature of the casing 30 and the value of the axial clearance L1, then the controller 20 can control the flow rate of the cooling medium supplied to the second stage cooling medium supply passage 23*c* to be substantially the same as the flow rate of the cooling medium supplied to the first stage cooling medium supply passage 23*a*. On the other hand, since the flow of the cooling medium supplied to the first stage side of the casing 30 can be controlled independently from the flow of the cooling medium to the second stage side of the casing 30 in the first embodiment, it is possible for the controller 20 to control the supply of cooling medium delivered to the second stage side of the casing at a different flow rate than the supply of cooling medium delivered to the first stage side of the casing. In this way, the control of the axial clearance L1 and the axial clearance L2 can be fine-tuned and tailored to the conditions on the first stage side and the second stage side, respectively.

Figure 6:
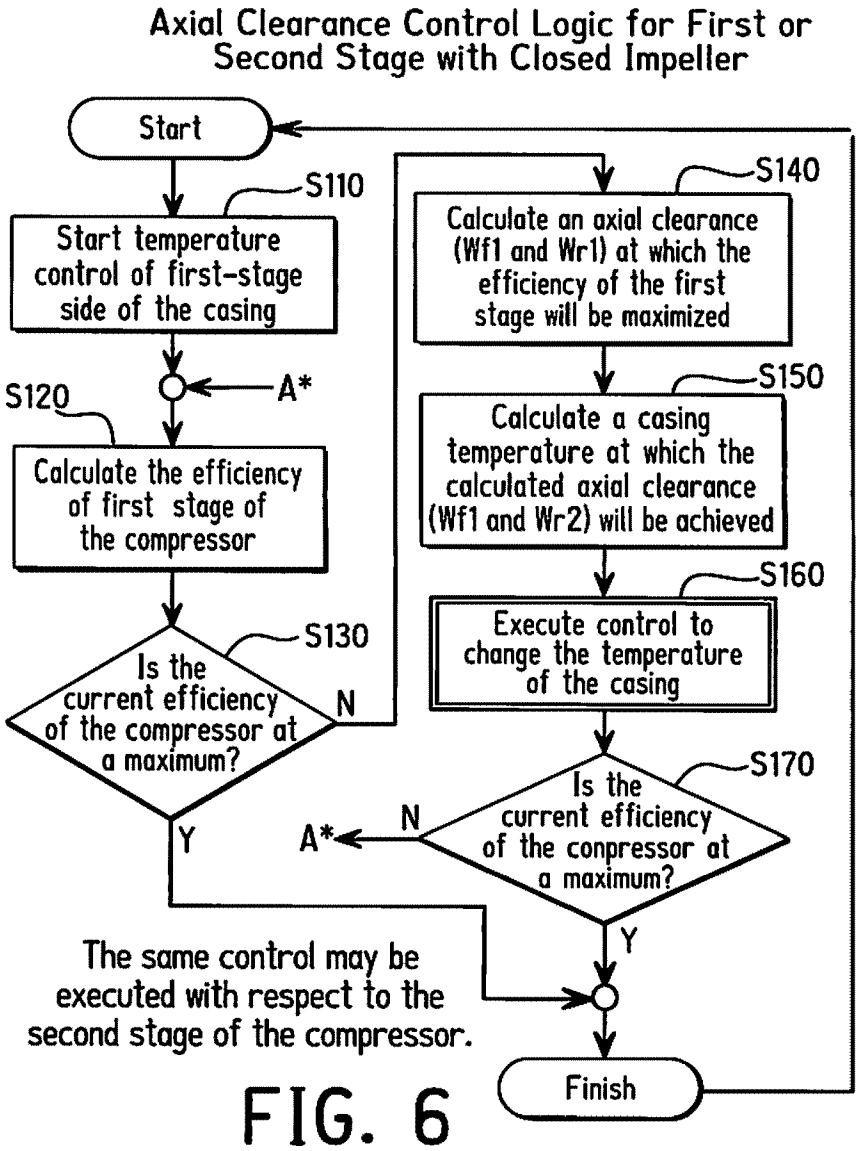
FIG. 6 is a flowchart illustrating a control logic for adjusting the axial clearance of the first stage impeller in a variation of the first embodiment having a closed impeller.

A variation of the first embodiment will now be explained with reference to FIG. 6. In this variation, the first stage impeller 34*a* and the second stage impeller 34*b* are both closed impellers having a shroud S fixed to the blades of the impeller 34*a* or 34*b*. In the case of a closed type impeller, the invention operates in basically the same manner as for an open type impeller in terms of controlling an axial clearance by controlling the supply of the cooling medium to the casing 30. However, when closed impellers are used, the balance of pressure between a rear side (axially inward side) and a front side (axially outward side) of the impeller affects the relationship between the axial clearance of the impeller and the efficiency of the compressor 22. Specifically, when the pressure on the rear side of the impeller is higher than the pressure on the front side of the impeller, then it is preferable to reduce the axial clearance between a rear surface of the impeller and an internal portion of the casing. For example, see Table 2 below and FIG. 8. Although the clearance is defined in terms of a pair of axial gaps Wf and Wr in the case of the closed impeller, it has been discovered that the sum of the two axial gaps Wf and Wr is typically substantially constant. Thus, for example, it is also possible to control the axial clearance of the closed first stage impeller 34*a* based solely on the axial clearance Wf1, which basically corresponds to the axial clearance L1 explained previously.

TABLE 2

| Pressure | Clearance | Leakage amt | Performance |
|---|---|---|---|
| Pf < Pr | Wf (0.3 mm) > Wr (0.1 mm) | ↓ | 100% |
| Pf > Pr | Wf (0.2 mm) = Wr (0.2 mm) | ↑ | 98% |

Thus, as shown in Table 2 above, the performance of the compressor 22 can be adjusted to a maximum performance level by controlling the axial clearances Wf1, Wr1, Wf2, and Wr2 of the first stage impeller 34*a* and the second stage impeller 34*b*, for example, in accordance with the pressures Pf (Pf1 or Pf2) and Pr (Pr1 or Pr2) on the front and rear sides of the respective impeller 34*a* or 34*b*. The control of the impeller clearance (clearances Wf1 and Wr1) executed by the controller 20 in accordance with this variation of the first embodiment will now be explained with reference to FIG. 6. Although the control will be explained with reference to the first stage side of the compressor 22, it will be recognized that the same control steps may be executed with respect to the second stage side of the compressor 22. The pressures Pf and Pr can be measured with pressure sensors PS1f, PS1r, PS2f, and PS2r arranged appropriately on the front and rear sides of the impellers 34*a* and 34*b*.

In step S110, the controller 20 starts the impeller clearance control. In step S120, the controller 20 calculates an efficiency of the first stage side of the compressor 22 based on, for example, a pressure Pr1 on a rear side (axially inward side) of the first stage impeller 34*a* and a pressure Pf1 on a front side (axially outward side) of the first stage impeller 34*a*. Then, in step S130, the controller 20 determines if the calculated efficiency of the first stage side of the compressor 22 is at a prescribed maximum efficiency value. If the calculated efficiency is the maximum efficiency, then the controller 20 ends the impeller clearance control. Otherwise, if the calculated efficiency is below the maximum efficiency, then the controller 20 proceeds to step S140.

In step S140, the controller 20 calculates a value of the axial clearance Wf1 on the front side of the first stage impeller 34*a* and a value of the axial clearance Wr1 on the rear side of the first stage impeller 34*a* at which the efficiency of the first stage of the compressor 22 will be maximized. Then, in step S150, the controller 20 calculates a casing temperature at which the axial clearance Wf1 and the axial clearance Wr1 will be equal to the values calculated in step S140. In step S160, the controller 20 executes a control to change the temperature of the casing to match the casing temperature calculated in step S150. The controller 20 executes the control to change the temperature of the casing 30 as explained previously regarding step S60.

Next, in step S170, the controller 20 again determines if the calculated efficiency of the first stage side of the compressor 22 is at the prescribed maximum efficiency value. If the result of step S170 is that the calculated efficiency of the first stage side of the compressor 22 is at the prescribed maximum efficiency value, then the controller 20 ends the control sequence. If the result of step S170 is that the calculated efficiency is below the prescribed maximum efficiency value, then the controller 20 returns to step S120 of the control sequence.

Thus, as explained above, the first embodiment can be implemented in basically same manner regardless of whether the first and second stage impellers 34*a* and 34*b* are open impellers or closed impellers. However, the factors considered in determining the target value of the axial gap may be different depending on whither closed impellers or open impellers are used.

Second Embodiment

A second embodiment of the present invention will now be explained with reference to FIGS. 7-11. As shown in FIGS. 7-9, the second embodiment is similar to the first embodiment. Parts that are the same as in the first embodiment are indicated with the same reference numerals as in the first embodiment, and descriptions thereof have been omitted for the sake of brevity. The main differences are that the casing 30' of the second embodiment does not include a partition and the cooling medium delivery structure 23' of the second embodiment is not configured to deliver separate supplies of the cooling medium to the first and second stage sides of the casing 30'. Instead, as shown in FIG. 9, the cooling medium delivery structure 23' of the second embodiment has a single cooling medium supply passage 23*a*' to supply the cooling medium to the casing 30' and a single cooling medium return passage 23*b*' to carry the cooling medium away from the casing 30'. Persons of ordinary skill in the refrigeration and air conditioning fields will recognize that numerous variations of the cooling medium delivery structure 23' are possible. For example, it is possible to have a plurality of each of the cooling medium supply passage 23*a*' and the cooling medium return passage 23*b*' so long as the internal structure for routing the cooling medium through the casing 30' is common (not separate) for the first and second stage sides of the casing 30'. Moreover, various configurations of the internal structure for routing the cooling medium are possible.

Additionally, in the second embodiment as shown in FIG. 7, the casing 30' does not have a bellows joint and the first and second stage impellers 34*a*' and 34*b*' are closed impellers not open compellers. However, it is acceptable for casing 30' of the second embodiment to have a bellows joint, and it is acceptable for the second embodiment to be implemented with a compressor having open type impellers. Also, the second embodiment features labyrinth seals LS between end portions of the impellers 34*a*' and 34*b*' and the casing 30' as indicated in FIG. 8.

The control executed by the controller 20' in the second embodiment will now be explained with reference to FIG. 10. The control steps are basically the same as in the previously explained variation the first embodiment (see FIG. 6) except that the control steps apply to both the first stage side and the second stage side of the compressor 22' because the cooling medium delivery structure 23' is not configured to supply the cooling medium separately with respect to the first and second stage sides of the compressor 22'.

In step S210, the controller 20' starts the impeller clearance control. In step S220, the controller 20' calculates an efficiency of the first and second stage sides of the compressor 22' based on at least a pressure Pr1 on a rear side (axially inward side) of the first stage impeller 34*a* and a pressure Pf1 on a front side (axially outward side) of the first stage impeller 34*a*, and based on at least a pressure Pr2 on a rear side (axially inward side) of the second stage impeller 34*b* and a pressure Pf2 on a front side (axially outward side) of the second stage impeller 34*b*. Then, in step S230, the controller 20' determines if the calculated efficiencies of the first and second stage sides of the compressor 22' are at a prescribed maximum efficiency value. If the calculated efficiency is the maximum efficiency, then the controller 20' ends the impeller clearance control. Otherwise, if the calculated efficiency is below the maximum efficiency, then the controller 20' proceeds to step S240.

In step S240, the controller 20' calculates a value of the axial clearance Wf1 on the front side of the first stage impeller 34*a* and a value of the axial clearance Wr1 on the rear side of the first stage impeller 34*a* at which the efficiency of the first stage of the compressor 22' will be maximized. Additionally, the controller 20' calculates a value of the axial clearance Wf2 on the front side of the second stage impeller 34*b* and a value of the axial clearance Wr2 on the rear side of the second stage impeller 34*b* at which the efficiency of the first stage of the compressor 22' will be maximized. Then, in step S250, the controller 20' calculates a casing temperature at which the axial clearances Wf1, Wr1, Wf2, and Wr2 will be equal to the values calculated in step S240. In step S260, the controller 20' executes a control to change the temperature of the casing 30' to match the casing temperature calculated in step S250. The controller 20' executes the control to change the temperature of the casing 30' as explained previously regarding step S60 of FIG. 5 in the first embodiment. See FIG. 12 for an example of the control logic of step S260.

Additionally, regarding steps S250 and S260, the controller 20' can be programmed such that if the efficiencies of the first and second sides of the compressor 22' are different, then the controller 20' calculates a casing temperature that corresponds to an appropriately balanced adjustment amount of the axial clearances on both sides of the compressor 22'. For example, the controller 20' can be programmed to calculate a first casing temperature based on the efficiency on the first stage side and a second casing temperature based on the efficiency on the second stage side. Then, the controller can use an average of the first casing temperature and the second casing temperature as a target casing temperature in step S260.

Next, in step S270, the controller 20' again determines if the calculated efficiencies of the first and second stage sides of the compressor 22' are at the prescribed maximum efficiency value. If the result of step S170 is that the calculated efficiencies of the first and second stage sides of the compressor 22' are at the prescribed maximum efficiency value, then the controller 20' ends the control sequence. If the result of step S270 is that the calculated efficiency is below the prescribed maximum efficiency value, then the controller 20' returns to step S220 of the control sequence.

A variation of the second embodiment will now be explained with reference to FIG. 11. In this variation, the first stage impeller 34*a* and the second stage impeller 34*b* are both open impellers as explained in the first embodiment. Thus, the control steps shown in FIG. 11 are basically the same as the control steps shown in FIG. 5 of the first embodiment except that the axial clearances L1 and L2 of both of the impellers 34*a* and 34*b* are taken into consideration simultaneously.

In step S310, the controller 20' starts the impeller clearance control. In step S320, the controller 20' calculates efficiencies of the first and second stage sides of the compressor 22' based on such factors as rotational speed of the compressor 22', a pressure difference across the first stage impeller 34*a* and the second stage impeller 34*b*, and a flow rate of the refrigerant through the first stage side and the second stage side of the compressor 22', respectively. Then, in step S330, the controller 20' determines if the calculated efficiencies of the first and second stage sides of the compressor 22' is at a prescribed maximum efficiency value. If the calculated efficiencies are the maximum efficiency, then the controller 20' ends the impeller clearance control. Otherwise, if the calculated efficiencies are below the maximum efficiency, then the controller 20' proceeds to step S340.

In step S340, the controller 20' calculates a value of the axial clearance L1 and a value of the axial clearance L2 at which the efficiencies of the first and second stages will be maximized. Then, in step S350, the controller 20' calculates a casing temperature at which the axial clearances L1 and L2 will be equal to the calculated axial clearance value at which the efficiency of the first and second stages of the compressor 22' will be maximized. In step S360, the controller 20' executes a control to change the temperature of the casing to match the casing temperature calculated in step S350. As explained previously regarding the first embodiment, the controller 20' executes the control to change the temperature of the casing 30' by, for example, adjusting an opening degree of a flow control valve (not shown) of the cooling medium delivery structure 23 to control a flow rate of the cooling medium flowing to the casing 30'. See FIG. 12 for an example of the control logic of step S360.

Additionally, regarding steps S350 and S360, the controller 20' can be programmed such that if the efficiencies of the first and second sides of the compressor 22' are different, then the controller 20' calculates a casing temperature that corresponds to an appropriately balanced adjustment amount of the axial clearances on both sides of the compressor 22'. For example, the controller 20' can be programmed to calculate a first casing temperature based on the efficiency on the first stage side and a second casing temperature based on the efficiency on the second stage side. Then, the controller can use an average of the first casing temperature and the second casing temperature as a target casing temperature in step S360.

Next, in step S370, the controller 20' again determines if the calculated efficiency of the first stage side of the compressor 22' is at the prescribed maximum efficiency value. If the result of step S370 is that the calculated efficiency of the first stage side of the compressor 22' is at the prescribed maximum efficiency value, then the controller 20' ends the control sequence. If the result of step S370 is that the calculated efficiency is below the prescribed maximum efficiency value, then the controller 20' returns to step S320' of the control sequence.

Figure 12:
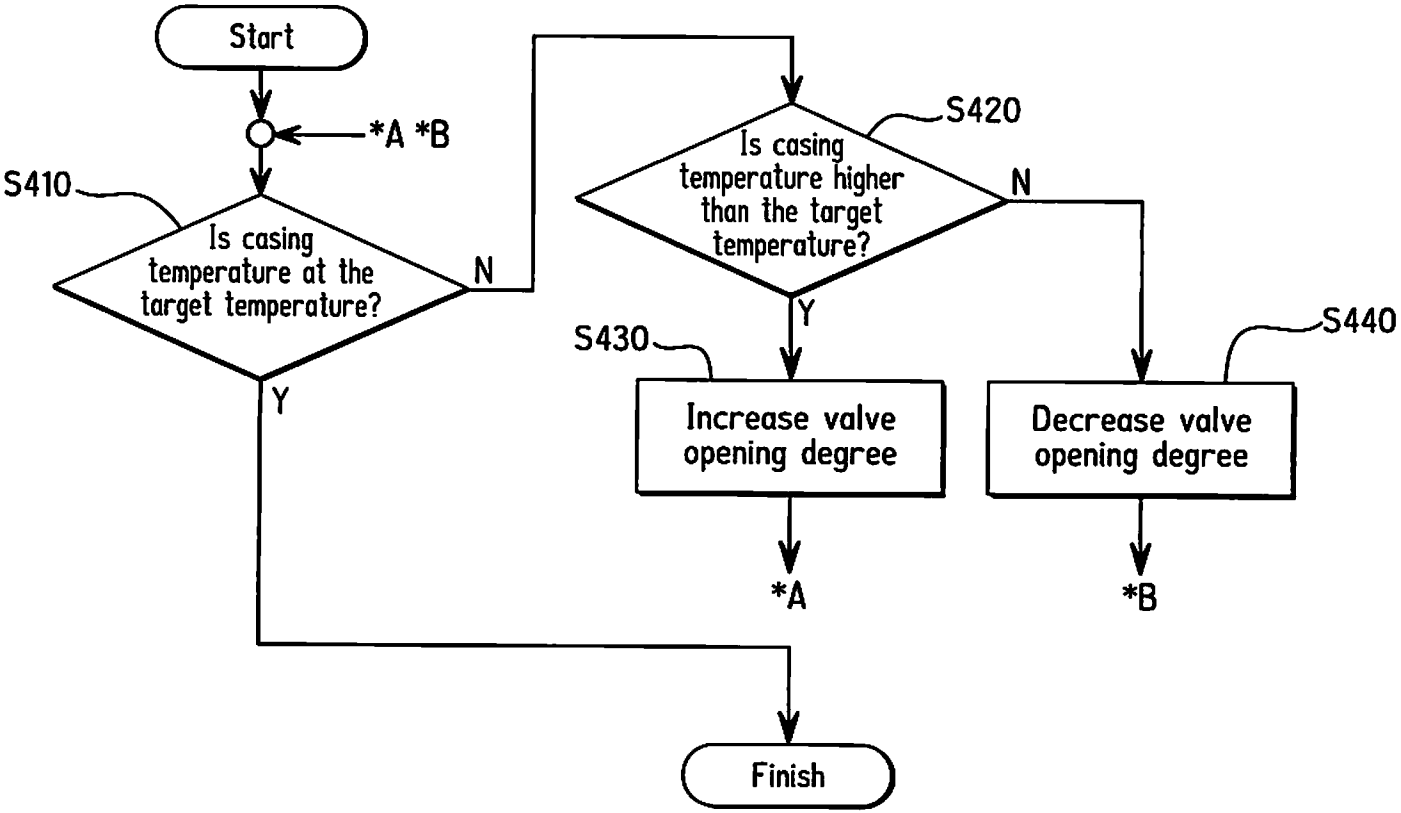
FIG. 12 is a flowchart illustrating an example of a control logic used to control the temperature of the casing in the first and second embodiments.
Figure 13:
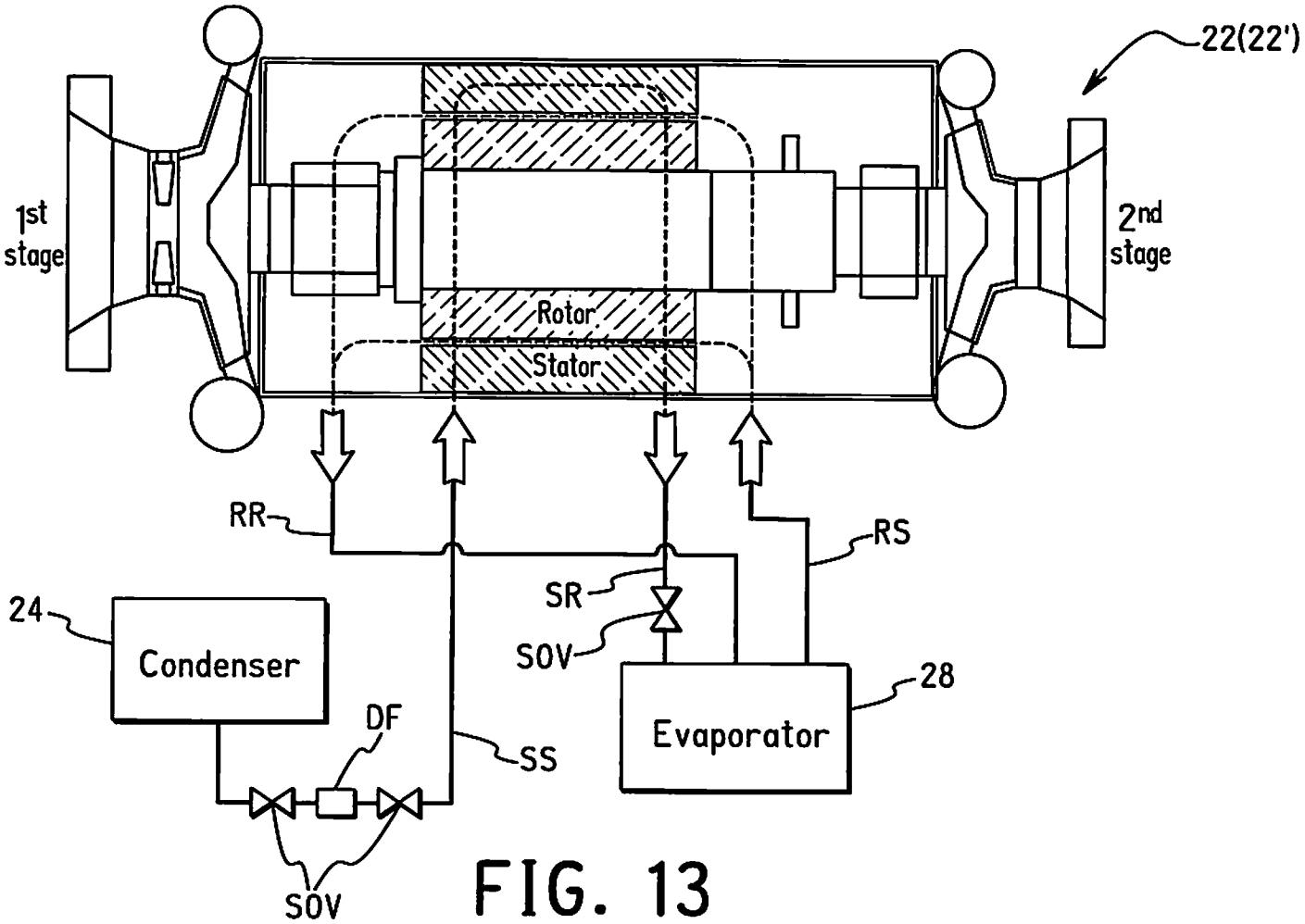
FIG. 13 is a partial schematic diagram illustrating a first example of stator and rotor cooling flow paths applicable to the cooling medium delivery systems of the first and second embodiments.
Figure 14:
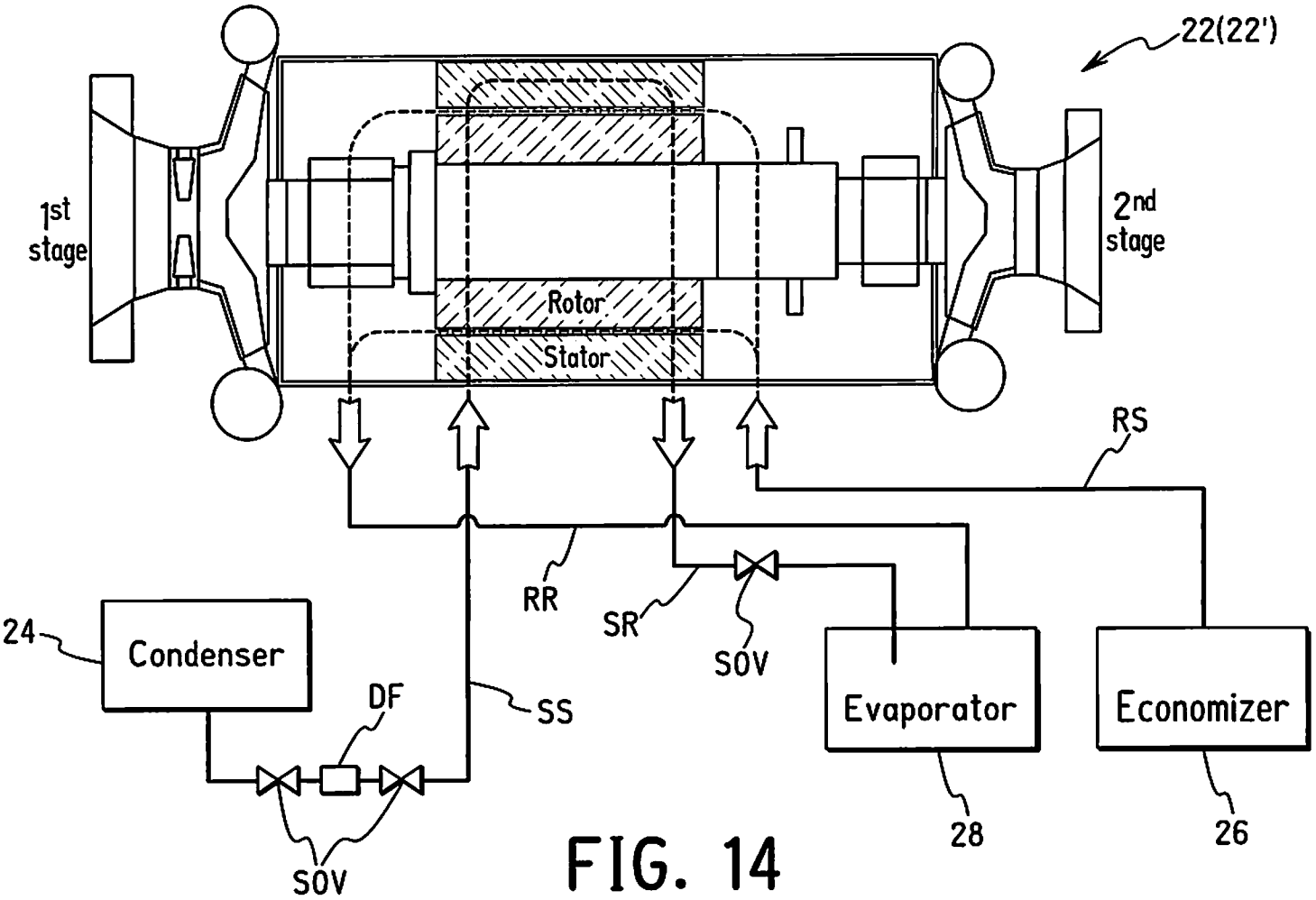
FIG. 14 is partial schematic diagram illustrating a second example of stator and rotor cooling flow paths applicable to the cooling medium delivery systems of the first and second embodiments.
Figure 15:
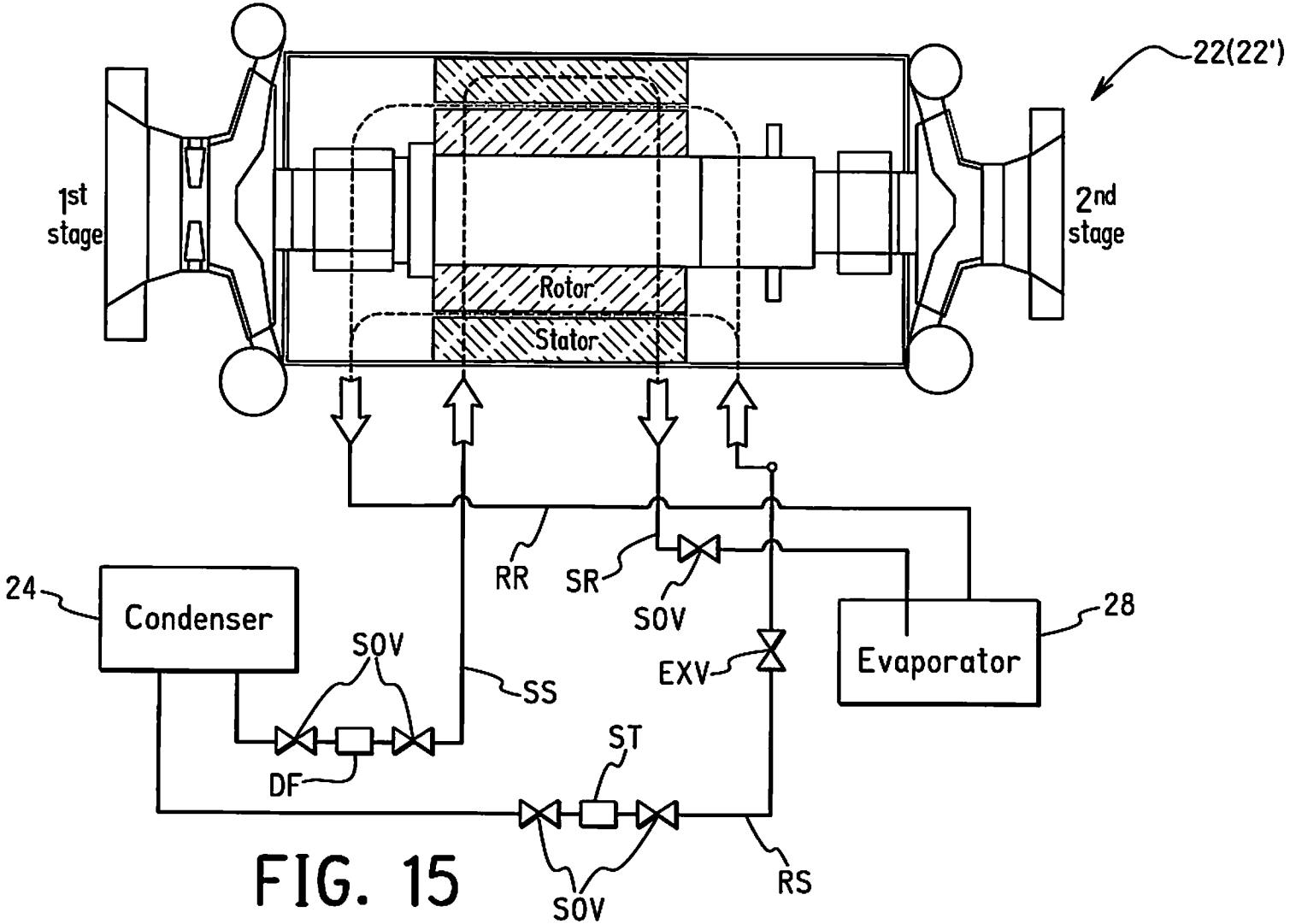
FIG. 15 is partial schematic diagram illustrating a third example of stator and rotor cooling flow paths applicable to the cooling medium delivery systems of the first and second embodiments.
Figure 16:
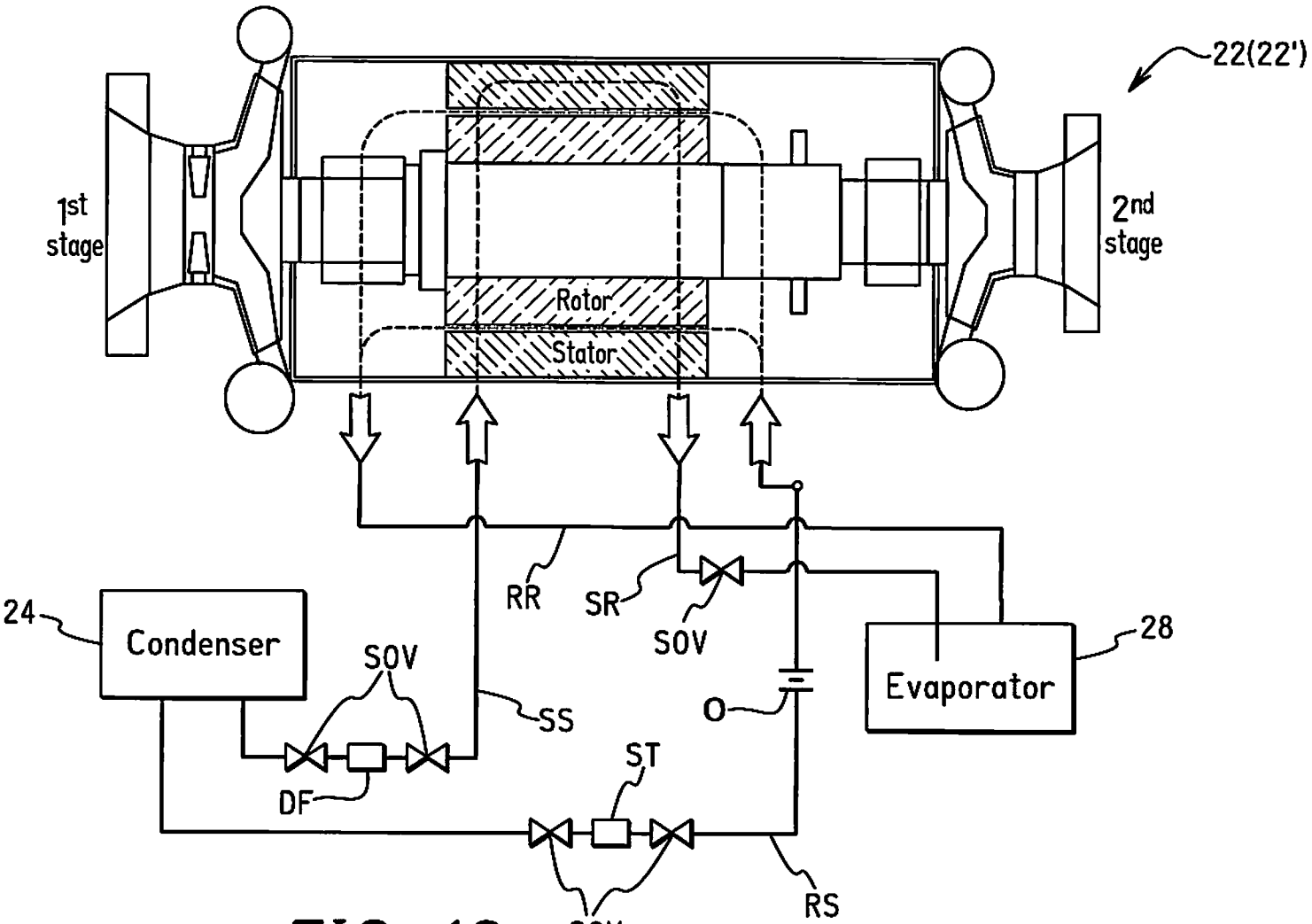
FIG. 16 is partial schematic diagram illustrating a fourth example of stator and rotor cooling flow paths applicable to the cooling medium delivery systems of the first and second embodiments.

The control logic of FIG. 12 will now be explained. In step S410, the controller 20 or 20' checks a currently detected casing temperature and compares the detected casing temperature to the target temperature at which the desired axial clearance will be achieved. The target temperature is, for example, the temperature calculated in step S50 of FIG. 5, step S150 of FIG. 6, step S250 of FIG. 10, or step S350 of FIG. 11. The temperature of the casing 30 is detected with, for example, the temperature sensors TS1 and TS2 shown in FIGS. 2 and 7. In step S420, the controller 20 or 20' determines if the detected casing temperature is higher than the target temperature. If the detected temperature is higher than the target temperature, the controller 20 or 20' proceeds to step S430. Otherwise, the controller 20 or 20' proceeds to step S440. In steps S430, the controller 20 or 20' controls a valve to increase the opening degree of the valve and, thereby, increase a flow of cooling medium to the casing 30. In step S440, the controller 20 or 20' controls a valve to decrease the opening degree of the valve and, thereby, decrease the flow of cooling medium to the casing 30. For example, the controller 20 or 20' controls the solenoid valves SOV shown in any one of FIGS. 13-16.

After step S430 or S440, the controller 20 or 20' returns to step S410 to check if the detected casing temperature equals the target temperature. If the detected casing temperature does not equal the target temperature, the controller 20 or 20' repeats step S420. If the detected casing temperature equals the target temperature, then the controller 20 or 20' ends the temperature control.

Examples of circuit configurations for the cooling medium delivery structure 23' of the second embodiment will now be presented with reference to FIGS. 13-16. Similar configurations can be made for the cooling medium deliver structure 23 of the first embodiment. These examples are borrowed from U.S. patent application Ser. No. 15/072,975 and are not intended to limit the current invention. These examples are designed for a motor cooling application, but can be used to cool the casing 30 as well. Any arrangement that can supply refrigerant or another cooling medium to the compressor 22 or 22' in a variable manner to adjust the temperature of the casing 30 is acceptable.

In each of FIGS. 13-16, a stator supply line SS and a stator return lines SR are provided in the same configuration. Each stator supply line SS includes two solenoid valves SOV sandwiching a dryer filter DF therebetween. Each stator return line SR includes a solenoid valve SOV. In addition, a rotor return line RR for each of FIGS. 3-6 is also the same. However, the rotor supply lines RS for FIGS. 3-6 are different.

In FIG. 3 the rotor supply line RS delivers cooling fluid from the evaporator 28 to the motor 38. In FIG. 4 the rotor supply line RS delivers cooling fluid from the economizer 26 to the motor 38. In FIG. 5 the rotor supply line RS delivers cooling fluid from the condenser 24 to the motor 38. In this option, the rotor supply line RS includes solenoid valves SOV sandwiching a strainer ST therebetween, and with an expansion valve EXV downstream. In FIG. 6 the rotor supply line RS delivers cooling fluid from the condenser 24 to the motor 38. In this option, the rotor supply line RS includes solenoid valves SOV sandwiching a strainer ST therebetween, and with an orifice O downstream. In each of these arrangements, the temperature of the casing 30 can be adjusted by controlling the solenoid valves SOV.

As should be clear from the embodiments and variations thereof explained above, the present invention enables an axial clearance of an impeller of a compressor to be adjusted by controlling a temperature of a casing of the compressor. The present invention is not limited to the particular configurations and arrangements presented in the preceding embodiments. For example, as mentioned previously, various modifications can be made to the cooling medium delivery structures 23 and 23' so long as the supply of the cooling medium can be adjusted in order to vary the temperature of the casing 30 or 30'.

Additionally, the present invention is not limited to determining a target casing temperature at which a maximum efficiency is achieved and controlling the supply of cooling medium such that the temperature of the casing is adjusted to the target casing temperature. For example, the axial clearance (e.g., any one or combination of L1, L2, Wf1, Wr1, Wf2, and Wr2) may be detected with gap sensors 58 and the supply of the cooling medium can be controlled using a feedback logic to maintain the axial clearance at a particular value or to be within a particular range of values. The axial clearance can be measured, for example, with a sensor arranged to measure the axial clearance directly, or with a gap sensor arranged to measure a gap of a magnetic bearing (the axial clearance can then be calculated based on the measurement of the gap in the magnetic bearing). In the illustrated embodiment, the gap sensors 58 are arranged to measure axial gaps in the magnetic bearing 48.

Also, although the illustrated embodiments feature a two stage centrifugal compressor 22 or 22', the present invention is not limited to such a compressor. For example, the compressor may have two sides with two impellers arranged axially opposite to each other but not connected in a two stage arrangement. Additionally, the present invention is applicable a compressor having a single impeller or three or more impellers so long as the geometry and structure of the compressor are compatible with adjusting an axial clearance by controlling a temperature of the casing. Additionally, although the illustrated embodiments feature two temperature sensors TS1 and TS2, it is also possible to use one temperature sensor or three or more temperature sensors to determine the temperature of the casing 30 or 30'. In the first embodiment, it is also possible to provide a first temperature sensor TS1 to detect a temperature of the first stage side of the casing, a second temperature TS2 sensor to detect a temperature of the second stage side of the casing, and to control the supply of the cooling medium to the first and second stage sides of the casing independently based on the respective temperatures detected by the first and second temperature sensors TS1 and TS2.

Experimental data will now be presented which demonstrates a representative correspondence between the casing temperature and the amount of movement of the casing due to thermal expansion and contraction. See Table 3 below. This kind of data can be used to determine an adjustment amount of the axial clearance with respect to the casing temperature. The data presented herein are merely examples of data that can be obtained experimentally. The actual measurement values may vary depending on the structure and operating conditions of a particular compressor.

In the table, room temperature (68° F.) is used as a reference and, thus, the amount of movement is 0 inch at 68° F. Also, Table 3 shows data for a case in which a bellows joint is not provided in the casing (similarly to the second embodiment).

TABLE 3

(Without Bellows Joint)

| Casing temperature (° F.) | Casing movement amount | Movement direction |
|---|---|---|
| 32 | −0.002 inch | Contraction |
| 50 | −0.001 inch | Contraction |
| 68 | 0 inch | N/A |
| 100 | +0.002 inch | Expansion |
| 150 | +0.005 inch | Expansion |

Experimental temperature and casing movement data for a case in which a bellows joint is provided in the casing is presented in Table 4 below. As indicated by the data in comparison with Table 3, the amount of movement is larger with the bellows joint than without the bellows joint.

TABLE 4

(With Bellows Joint)

| Casing temperature (° F.) | Casing movement amount | Movement direction |
|---|---|---|
| 32 | −0.004 inch | Contraction |
| 50 | −0.002 inch | Contraction |
| 68 | 0 inch | N/A |
| 100 | +0.005 inch | Expansion |
| 150 | +0.012 inch | Expansion |

The materials of the housing (casing 30) and the shaft 42 of the compressor 22 or 22' are selected to provide adequate movement of the casing 30 with respect to the shaft 42 in response to temperature changes of both the casing 30 and the shaft 42. In some configurations, it may not be possible to adjust the temperature of the casing 30 without also affecting the temperature of the shaft 42. Thus, the relative thermal expansion coefficients of the casing 30 and the shaft 42 are taken into consideration to ensure sufficient movement of the casing 30 relative to the shaft 42 in response to controlling temperature of the casing 30.

Additionally, the shape of the casing 30, including but not limited to the motor housing portion 35, is designed to ensure that the axial movement of the casing 30 in response to temperature changes is uniform and the casing 30 does not undergo bending or twisting deformation in response to temperature changes that occur during operation of the centrifugal compressor 22 or 22'. Moreover, the material and geometry of the casing are selected to ensure that stress tolerances of the casing material are not exceeded even when the temperature of the casing varies over a range of temperatures at least as wide as might be reasonably expected during operation of the centrifugal compressor 22 or 22'.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A centrifugal compressor comprising:

a casing having a first end portion, a second end portion, and a motor housing portion disposed between the first end portion and the second end portion, the first end portion including a first inlet portion and a first outlet portion, and the second end portion including a second inlet portion and a second outlet portion;

a first impeller disposed between the first inlet portion and the first outlet portion, the first impeller being attached to a shaft rotatable about a rotation axis, the shaft having a first end and a second end and the first impeller being attached to the first end, a first axial gap existing between at least a portion of the first impeller and the casing;

a motor arranged inside the motor housing portion of the casing to rotate the shaft in order to rotate the first impeller, the motor including a rotor mounted on the shaft and a stator disposed radially outwardly of the rotor to form a radial gap between the rotor and the stator;

a second impeller attached to the second end of the shaft on an opposite side of the motor from the first impeller, the second impeller being disposed between the second inlet portion and the second outlet portion of the casing, a second axial gap existing between at least a portion of the second impeller and the casing; and a cooling medium delivery structure including an inlet conduit located to supply a cooling medium to the casing and an outlet conduit located to discharge the cooling medium from the casing, the cooling medium delivery structure being configured to vary a flow rate of the cooling medium supplied to the casing, a portion of the shaft between the first end and the rotor being supported with respect to the casing by a first bearing, the first bearing being moveable with respect to the shaft in an axial direction of the shaft, a portion of the shaft between the second end and the rotor being supported with respect to the casing by a second bearing, and the second bearing being moveable with respect to the shaft in the axial direction of the shaft, the cooling medium delivery structure including a first side cooling medium delivery structure having a first inlet conduit located to supply a cooling medium to a first stage side of the casing, and a first outlet conduit located to discharge the cooling medium from the first stage side of the casing, and a second side cooling medium delivery structure having a second inlet conduit located to supply the cooling medium to a second stage side of the casing, and a second outlet conduit located to discharge the cooling medium from the second stage side of the casing, and a partition being formed on an inside of the motor housing portion of the casing at a middle position of the casing in the axial direction of the shaft, the partition encircling the stator of the motor and having one side in contact with the cooling medium of the first side cooling medium delivery structure and another side in contact with the cooling medium of the second side cooling medium delivery structure such that the cooling medium of the first side cooling medium delivery structure is isolated from the cooling medium of the second side cooling medium delivery structure in a space existing radially-between the motor housing portion of the casing and the stator of the motor, the partition being narrower than the stator and the rotor in the axial direction of the shaft and arranged such that the stator and the rotor extend beyond both sides of the partition in the axial direction.

2. The centrifugal compressor according to claim 1, wherein the first impeller is a closed impeller provided with a first shroud that at least partially covers blades of the first impeller, the first axial gap being a distance between the first shroud and the casing.

3. The centrifugal compressor according to claim 1, wherein the first impeller is an open impeller surrounded by a first shroud portion of the casing, the first axial gap being a distance between a blade of the first impeller and the first shroud portion of the casing.

4. The centrifugal compressor according to claim 1, wherein the bearing is a magnetic bearing.

5. The centrifugal compressor according to claim 1, wherein the casing includes a bellows joint provided at an intermediate position located between the first end and the second end of the shaft.

6. The centrifugal compressor according to claim 1, wherein the second impeller is a closed impeller provided with a second shroud that at least partially covers blades of the second impeller, and the second axial gap is between the second shroud and the casing.

7. The centrifugal compressor according to claim 1, wherein the second impeller is an open impeller surrounded by a second shroud portion of the casing, the second axial gap being a distance between a blade of the second impeller and the second shroud portion of the casing.

8. The centrifugal compressor according to claim 1, wherein a first bellows joint is provided on the first side of the casing, and a second bellows joint is provided on the second side of the casing.

9. The centrifugal compressor according to claim 1, wherein the axial gap is in the range 0.2 to 0.5 millimeters.

10. An impeller clearance control apparatus for a centrifugal compressor including a casing having a first end portion, a second end portion, and a motor housing portion disposed between the first end portion and the second end portion, the first end portion including a first inlet portion and a first outlet portion, and the second end portion including a second inlet portion and a second outlet portion;

a first impeller disposed between the first inlet portion and the first outlet portion, the first impeller being attached to a shaft rotatable about a rotation axis, the shaft having a first end and a second end and the first impeller being attached to the first end, a first axial gap existing between at least a portion of the first impeller and the casing;

a motor arranged inside the motor housing portion of the casing to rotate the shaft in order to rotate the first impeller, the motor including a rotor mounted on the shaft and a stator disposed radially outwardly of the rotor to form a radial gap between the rotor and the stator;

a second impeller attached to the second end of the shaft on an opposite side of the motor from the first impeller, the second impeller being disposed between the second inlet portion and the second outlet portion of the casing, a second axial gap existing between at least a portion of the second impeller and the casing; and a cooling medium delivery structure including an inlet conduit located to supply a cooling medium to the casing and an outlet conduit located to discharge the cooling medium from the casing, the cooling medium delivery structure being configured to vary a flow rate of the cooling medium supplied to the casing, a portion of the shaft between the first end and the rotor being supported with respect to the casing by a first bearing, the first bearing being moveable with respect to the shaft in an axial direction of the shaft, a portion of the shaft between the second end and the rotor being supported with respect to the casing by a second bearing, and the second bearing being moveable with respect to the shaft in the axial direction of the shaft, the cooling medium delivery structure including a first side cooling medium delivery structure having a first inlet conduit located to supply a cooling medium to a first stage side of the casing, and a first outlet conduit located to discharge the cooling medium from the first stage side of the casing, and a second side cooling medium delivery structure having a second inlet conduit located to supply the cooling medium to a second stage side of the casing, and a second outlet conduit located to discharge the cooling medium from the second stage side of the casing, and a partition being formed on an inside of the motor housing portion of the casing at a middle position of the casing in the axial direction of the shaft, the partition encircling the stator of the motor and having one side in contact with the cooling medium of the first side cooling medium delivery structure and another side in contact with the cooling medium of the second side cooling medium delivery structure such that the cooling medium of the first side cooling medium delivery structure is isolated from the cooling medium of the second side cooling medium delivery structure in a space existing radially-between the motor housing portion of the casing and the stator of the motor, the partition being narrower than the stator and the rotor in the axial direction of the shaft and arranged such that the stator and the rotor extend beyond both sides of the partition in the axial direction, the impeller clearance control apparatus comprising:

a sensor arranged and configured to detect a value indicating a condition of the centrifugal compressor that correlates to a size of an axial gap between an impeller of the compressor and an internal portion of a casing of the compressor; and a controller arranged to receive a signal from the sensor indicating the detected value, the controller being programmed to control a supply of a cooling medium to the casing based on the detected value such that the size of the axial gap is adjusted to a target axial gap value.

11. The impeller clearance control apparatus according to claim 10, wherein the sensor detects a temperature of a casing of the centrifugal compressor and the value indicates the detected temperature.

12. The impeller clearance control apparatus according to claim 10, wherein the sensor is a gap sensor arranged and configured detect an axial distance between two portions of the centrifugal compressor, and the value correlates to the detected axial distance.

13. The impeller clearance control apparatus according to claim 10, wherein the controller is programmed to independently control a first supply of the cooling medium to a first side of casing and a second supply of the cooling medium to a second side of the casing.

14. The impeller clearance control apparatus according to claim 13, wherein the sensor detects a first value that correlates to a first axial gap between a first impeller of the compressor and a first internal portion of the casing, and a second value that correlates to a second axial gap between a second impeller of the compressor and a second internal portion of the casing, the first impeller being arranged inside the first stage side of the casing and the second impeller being arranged inside the second stage side of the casing, and the controller is programmed to control the first supply of the cooling medium and the second supply of the cooling medium based on the first value and the second value.

15. An impeller clearance control method for a centrifugal compressor including a casing having a first end portion, a second end portion, and a motor housing portion disposed between the first end portion and the second end portion, the first end portion including a first inlet portion and a first outlet portion, and the second end portion including a second inlet portion and a second outlet portion;

a first impeller disposed between the first inlet portion and the first outlet portion, the first impeller being attached to a shaft rotatable about a rotation axis, the shaft having a first end and a second end and the first impeller being attached to the first end, a first axial gap existing between at least a portion of the first impeller and the casing;

a motor arranged inside the motor housing portion of the casing to rotate the shaft in order to rotate the first impeller, the motor including a rotor mounted on the shaft and a stator disposed radially outwardly of the rotor to form a radial gap between the rotor and the stator;

a second impeller attached to the second end of the shaft on an opposite side of the motor from the first impeller, the second impeller being disposed between the second inlet portion and the second outlet portion of the casing, a second axial gap existing between at least a portion of the second impeller and the casing; and a cooling medium delivery structure including an inlet conduit located to supply a cooling medium to the casing and an outlet conduit located to discharge the cooling medium from the casing, the cooling medium delivery structure being configured to vary a flow rate of the cooling medium supplied to the casing, a portion of the shaft between the first end and the rotor being supported with respect to the casing by a first bearing, the first bearing being moveable with respect to the shaft in an axial direction of the shaft, a portion of the shaft between the second end and the rotor being supported with respect to the casing by a second bearing, and the second bearing being moveable with respect to the shaft in the axial direction of the shaft, the cooling medium delivery structure including a first side cooling medium delivery structure having a first inlet conduit located to supply a cooling medium to a first stage side of the casing, and a first outlet conduit located to discharge the cooling medium from the first stage side of the casing, and a second side cooling medium delivery structure having a second inlet conduit located to supply the cooling medium to a second stage side of the casing, and a second outlet conduit located to discharge the cooling medium from the second stage side of the casing, and a partition being formed on an inside of the motor housing portion of the casing at a middle position of the casing in the axial direction of the shaft, the partition encircling the stator of the motor and having one side in contact with the cooling medium of the first side cooling medium delivery structure and another side in contact with the cooling medium of the second side cooling medium delivery structure such that the cooling medium of the first side cooling medium delivery structure is isolated from the cooling medium of the second side cooling medium delivery structure in a space existing radially-between the motor housing portion of the casing and the stator of the motor, the partition being narrower than the stator and the rotor in the axial direction of the shaft and arranged such that the stator and the rotor extend beyond both sides of the partition in the axial direction, the method comprising determining a size of an axial gap between an impeller and a casing of the centrifugal compressor; and controlling a flow of a cooling medium to the casing such that the size of the axial gap is adjusted to a target axial gap value using thermal expansion and contraction of the casing.

16. The casing cooling method according to claim 15, wherein the determining of the size of the axial gap is based on a detected temperature of the centrifugal compressor.

17. The casing cooling method according to claim 15, wherein the determining of the size of the axial gap is based on a detected distance between two portions of the centrifugal compressor.

* * * * *